US009915884B2

(12) United States Patent
Uchino et al.

(10) Patent No.: US 9,915,884 B2
(45) Date of Patent: Mar. 13, 2018

(54) TONER

(71) Applicant: Konica Minolta, Inc., Tokyo (JP)

(72) Inventors: Satoshi Uchino, Tokyo (JP); Shinya Obara, Tokyo (JP); Futoshi Kadonome, Kanagawa (JP); Noriyuki Kimpara, Aichi (JP); Ikuko Sakurada, Tokyo (JP); Takuya Takahashi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/274,304

(22) Filed: Sep. 23, 2016

(65) Prior Publication Data

US 2017/0123332 A1 May 4, 2017

(30) Foreign Application Priority Data

Nov. 2, 2015 (JP) ..... 2015-215662

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0827* (2013.01); *G03G 9/0819* (2013.01); *G03G 9/08711* (2013.01); *G03G 9/08755* (2013.01); *G03G 9/08795* (2013.01); *G03G 9/08797* (2013.01); *G03G 9/0918* (2013.01); *G03G 9/09716* (2013.01); *G03G 9/09725* (2013.01); *G03G 9/09791* (2013.01)

(58) Field of Classification Search

CPC ..... G03G 9/08755; G03G 9/08788; G03G 9/08786; G03G 9/09725

See application file for complete search history.

(56) References Cited

U.S. PATENT DOCUMENTS

2003/0198886 A1* 10/2003 Chen ..... G03G 9/09791 430/137.11
2014/0370427 A1* 12/2014 Sasaki ..... G03G 9/09725 430/105

FOREIGN PATENT DOCUMENTS

| | | | | |
|---|---|---|---|---|
| JP | 07-092736 | A | 4/1995 | |
| JP | 11-323396 | A | 11/1999 | |
| JP | 2003-058009 | A | 2/2003 | |
| JP | 2006251564 | A | 9/2006 | |
| JP | 2010-009044 | A | 1/2010 | |
| JP | 2010-102057 | * | 5/2010 | ..... G03G 9/08 |

(Continued)

OTHER PUBLICATIONS

Translation of JP 2010-102057 published May 2010.*

(Continued)

*Primary Examiner* — Peter L Vajda
(74) *Attorney, Agent, or Firm* — Lucas & Mercanti, LLP

(57) ABSTRACT

The toner of the present invention contains: a toner base particle, and a silica particle and a fatty acid metal salt particle adhering to a surface of the toner base particle. The toner base particle contains a crystalline polyester resin and an amorphous polyester resin. The toner particle has an average circularity of 0.945 to 0.965. The silica particle has a volume average particle size of 70 to 300 nm, and has an average circularity of 0.5 to 0.9. The fatty acid metal salt particle has a median diameter based on a volume of 0.50 to 2.00 μm.

9 Claims, 3 Drawing Sheets

(56) References Cited

FOREIGN PATENT DOCUMENTS

| | | | | | |
|---|---|---|---|---|---|
| JP | 2010-102057 | A | | 5/2010 | |
| JP | 2010128216 | A | | 6/2010 | |
| JP | 2010-160367 | A | | 7/2010 | |
| JP | 2011-034079 | A | | 2/2011 | |
| JP | 2011-064768 | A | | 3/2011 | |
| JP | 2012-177915 | A | | 9/2012 | |
| JP | 2013-117564 | | * | 6/2013 | ..... G03G 9/08 |
| JP | 2014-228654 | A | | 12/2014 | |
| JP | 2015-004869 | | * | 1/2015 | ..... G03G 9/087 |

OTHER PUBLICATIONS

Translation of JP 2013-117564 published Jun. 2013.*
Translation of the abstract of JP 2015-004869 published Jan. 2015.*
Product data sheet for Aerosil RX50, Oct. 2016; https://www.aerosil.com/www2/uploads/productfinder/AEROSIL-RX-50-EN.pdf.*
Notice of Reasons for Rejection dated Nov. 8, 2016 from corresponding Japanese Application; Japanese Patent Application No. 2015-215662; Translation of Notice of Reasons for Rejection; Total of 12 pages.

* cited by examiner

TONER

CROSS REFERENCE TO RELATED APPLICATIONS

This application is entitled to and claims the benefit of Japanese Patent Application No. 2015-215662, filed on Nov. 2, 2015, the disclosure of which including the specification, drawings and abstract is incorporated herein by reference in its entirety.

BACKGROUND OF THE INVENTION

1. Field of the Invention

The present invention relates to a toner.

2. Description of Related Art

Recently, for purposes of increasing a printing speed, increasing the number of usable types of paper, and reducing environmental load, there is a demand for reduction of thermal energy applied in fixing a toner image. In order to meet the demand, a technique to improve the low-temperature fixability of a toner is required, and as one of methods for achieving the technique, a crystalline resin having an excellent sharp melt property, such as crystalline polyester, is used as a binder resin.

For example, an electrostatic image developing toner using a binder resin containing a crystalline polyester resin and an amorphous resin is known. If a mixture of a crystalline polyester resin and an amorphous resin is used, a crystal portion of a toner particle is melted when the temperature of the toner particle exceeds the melting point of the crystalline polyester resin during heat fixing, and hence the crystalline polyester resin and the amorphous resin are compatibilized with each other. As a result, low-temperature fixability can be attained (see, for example, Japanese Patent Application Laid-Open No. 2006-251564).

On the other hand, there is also a demand for high image quality in recent years, and in order to meet with the demand for high image quality, examinations have been made on size reduction and spheroidization of a toner particle. The size reduction of a toner particle can improve the reproducibility of dots of a toner image formed on a surface of a photoconductor. Besides, the spheroidization of a toner particle can improve developability and transferability. As a result, fine-line reproducibility and printing performance can be improved.

Besides, there are known techniques to attain long-term stability in high image quality of a toner by focusing on an external additive adhering to a toner base particle. For example, a toner containing, as an external additive, deformed colloidal silica and a fatty acid metal salt particle is known. It is described that the toner can form high quality images for a long period of time and inhibit occurrence of cleaning failure (see, for example, Japanese Patent Application Laid-Open No. 2010-128216).

For supplying a toner to an image forming apparatus, a configuration in which a resin toner bottle containing a toner is loaded to replenish the toner is known. The toner reduced in size or spheroidized is, however, liable to be degraded in dischargeability from the toner bottle (hereinafter referred to as the bottle dischargeability). In particular, the toner using a polyester resin is liable to adsorb a water component, and hence the adhesion to the toner bottle is further enhanced, resulting in much more degrading the bottle dischargeability.

SUMMARY OF THE INVENTION

An object of the present invention is to provide a toner that has sufficient low-temperature fixability and bottle dischargeability, and is capable of forming high quality images for a long period of time.

To achieve at least one of the abovementioned objects, a toner reflecting one aspect of the present invention includes: a toner particle containing a toner base particle and an external additive adhering to a surface of the toner base particle, the toner base particle containing a crystalline polyester resin and an amorphous polyester resin, the toner particle having an average circularity of 0.945 or higher and lower than 0.965, the external additive containing a silica particle and a fatty acid metal salt particle, wherein the silica particle has a volume average particle size of 70 nm or more and 300 nm or less, the silica particle has an average circularity of 0.5 or higher and 0.9 or lower, and the fatty acid metal salt particle has a median diameter based on a volume of 0.50 μm or more and 2.00 μm or less.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
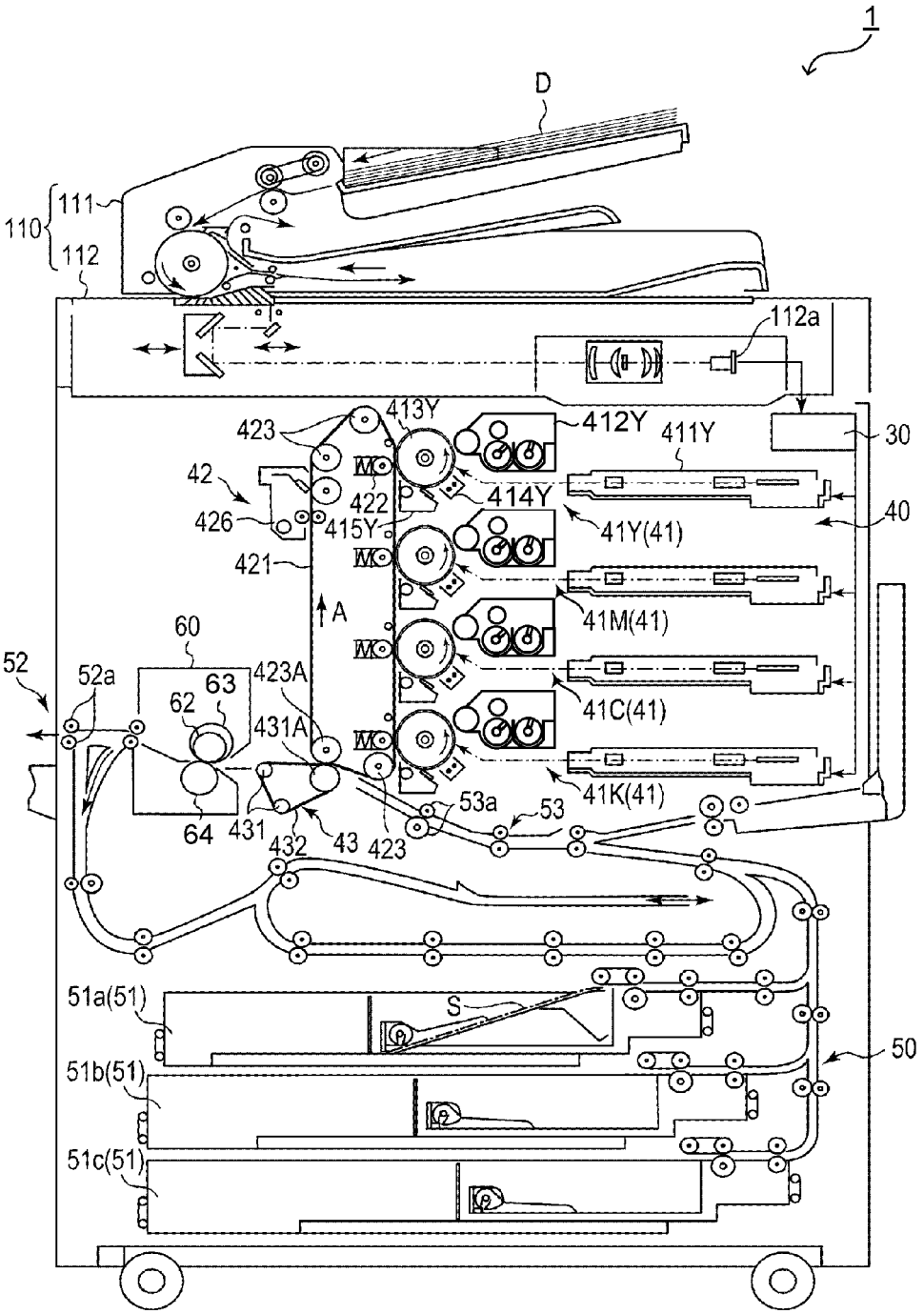
FIG. 1 is a schematic diagram illustrating an example of the structure of an image forming apparatus in which a toner according to an embodiment of the present invention is used.

An embodiment of the present invention will now be described. A toner according to the embodiment of the present invention includes a toner particle containing a toner base particle and an external additive adhering to the surface of the toner base particle.

The toner particle has an average circularity of 0.945 or higher and lower than 0.965. If the average circularity of the toner particle is 0.945 or higher, developability and transferability of a toner sufficient for forming a high quality image can be exhibited. If the average circularity of the toner particle is lower than 0.965, closest packing of the toner in a toner bottle is inhibited to exhibit sufficient flow ability of the toner within the toner bottle for a long period of time. If the average circularity of the toner particle is too low, desired image quality of a toner image cannot be realized, and if the average circularity of the toner particle is too high, the toner is packed in a closest state in the toner bottle, and hence, the bottle dischargeability (namely, the flow ability of the toner within the toner bottle) becomes insufficient.

The average circularity of the toner particle is measured using "FPIA-2100" (manufactured by Sysmex Corporation). Specifically, a measurement sample (toner particle) is blended in a surfactant-containing aqueous solution and dispersed by performing an ultrasonic dispersion treatment for 1 minute, and the resultant is imaged by "FPIA-2100" (manufactured by Sysmex Corporation) under measurement condition of HPF (high power field imaging) mode at a proper density of an HPF detection number of 3,000 to 10,000 to calculate the circularity of an individual toner particle in accordance with an equation below. A sum of the thus calculated circularities of toner particles is divided by the total number of the toner particles selected for the calculation so as to obtain the average circularity. The HPF detection number preferably falls in the above-described range from the viewpoint of reproducibility of the measurement result.

Circularity=(Perimeter of circle having the same projected area as particle image)/(Perimeter of projected image of particle)

The average circularity of the toner particle can be adjusted, for example, in accordance with aging conditions for associated particles in production of the toner base particle by emulsion polymerization, or by a heat treatment of the toner base particle or the toner particle.

A median diameter based on the volume of the toner particle is preferably 3 to 8 μm, and more preferably 5 to 8 μm. The median diameter falling in the above-described range is preferred from the viewpoint that a very fine dot image at a level of 1,200 dpi can be thus faithfully reproduced.

The median diameter based on the volume of the toner particle can be measured and calculated, for example, using a measurement apparatus including "Multisizer 3" (manufactured by Beckman Coulter Inc.) connected to a computer system into which data processing software "Software V3.51" has been loaded.

Specifically, 0.02 g of a measurement sample (a toner) is added to and blended with 20 mL of a surfactant solution (that is, a surfactant solution, used for dispersing the toner particle, obtained by, for example, 10-fold diluting a neutral detergent containing a surfactant component with pure water), and the resultant is subjected to the ultrasonic dispersion for 1 minute to prepare a toner dispersion. The toner dispersion is pipetted into a beaker disposed in a sample stand and charged with "ISOTONII" (manufactured by Beckman Coulter Inc.) until a concentration displayed in the measurement apparatus becomes 8%. From the viewpoint of obtaining a reproducible measurement value, the displayed concentration is preferably in the vicinity of this value.

In the measurement apparatus, the count number of measured particles and an aperture are respectively set to 25,000 and 100 μm, a measurement range of 2 to 60 μm is divided into 256 segments to calculate a frequency value of each segment, and 50% of particle sizes in a descending order of volume-based cumulative fractions is obtained to be defined as the median diameter based on the volume. In this manner, the median diameter based on the volume of the toner particle is obtained.

The median diameter can be adjusted in accordance with the extent of agglomeration and fusion of a fine particle of a binder resin employed in producing the toner base particle by the emulsion polymerization. Specifically, the median diameter can be controlled in accordance with a concentration of a flocculant to be used, an addition amount of an organic solvent, fusing time, the composition of a binder resin and the like.

The toner base particle contains a crystalline polyester resin and an amorphous polyester resin. One or more resins can be used as each of the crystalline polyester resin and the amorphous polyester resin. Contents of these resins in the toner base particle can be appropriately determined as long as the effects of the present embodiment can be obtained. For example, the contents can be appropriately determined within a range where a sea-island structure containing the crystalline polyester resin and the amorphous polyester resins respectively as islands and sea can be formed.

The term "crystalline" of the crystalline polyester resin refers to that the resin is changed in the endothermic amount not in a stepwise manner but with a clear endothermic peak in measurement with a differential scanning calorimeter (DSC). Specifically, the term means that a half width of an endothermic peak measured at a temperature rise rate of 10° C./min is 10° C. or lower. On the other hand, a resin whose half width exceeds 10° C., a resin changed in the endothermic amount in a stepwise manner, or a resin having no clear endothermic peak corresponds to an amorphous polyester resin (an amorphous polymer).

The crystalline polyester resin can be produced by a general polymerization method of polyester in which an acid component and an alcohol component are reacted with each other. Examples of the polymerization method include direct polycondensation and transesterification, and these polymerization methods are appropriately selectively employed in accordance with, for example, the type of monomers to be used. Alternatively, the crystalline polyester resin may be a commercially available product.

The crystalline polyester resin can be produced at a polymerization temperature of, for example, 180 to 230° C. With a pressure within a reaction system reduced if necessary, the monomers are reacted with each other with water and alcohol generated through condensation removed. If the monomers are not dissolved or compatibilized at a reaction temperature, dissolution may be caused by adding a solvent having a high boiling point as a solubilizing agent. In employing the polycondensation, the reaction is performed with a solubilizing agent distilled off. If there is any monomer having poor compatibility in a copolymerization reaction, the monomer may be precedently condensed with an acid or an alcohol to be polycondensed before polycondensation with a principal component.

The crystalline polyester resin has a molecular structure of a condensation polymerization product of a polycarboxylic acid and a polyhydric alcohol. One or more polycarboxylic acids may be used as the polycarboxylic acid. Examples of the polycarboxylic acid include aliphatic dicarboxylic acids, aromatic dicarboxylic acids, dicarboxylic acids having a double bond, tri- or higher-valent carboxylic acids, anhydrides of these, and lower alkyl esters of these. The dicarboxylic acids having a double bond have radical cross-linkage via the double bond, and hence are preferably used from the viewpoint of preventing hot offset otherwise occurring in fixing the toner particle.

Examples of the aliphatic dicarboxylic acids include oxalic acid, succinic acid, glutaric acid, adipic acid, suberic acid, azelaic acid, sebacic acid, 1,9-nonanedicarboxyic acid, 1,10-decanedicarboxylic acid, 1,12-dodecanedicarboxylic acid, 1,14-tetradecanedicarboxylic acid and 1,18-octadecanedicarboxylic acid.

Examples of the aromatic dicarboxylic acids include phthalic acid, isophthalic acid, terephthalic acid, naphthalene-2,6-dicarboxylic acid, malonic acid and mesaconic acid.

Examples of the dicarboxylic acids having a double bond include maleic acid, fumaric acid, 3-hexenedioic acid and 3-octenedioic acid. Among these, fumaric acid and maleic acid are preferably used from the viewpoint of cost.

Examples of the tri- or higher-valent carboxylic acids include 1,2,4-benzenetricarboxylic acid, 1,2,5-benzenetricarboxylic acid and 1,2,4-naphthalenetricarboxylic acid.

One or more polyhydric alcohols may be used as the polyhydric alcohol. Examples of the polyhydric alcohol include aliphatic diols and tri- or higher-hydric alcohols. Among these, the aliphatic diols are preferably used from the viewpoint of obtaining a crystalline polyester resin described later, and in particular, a straight chain aliphatic diol having 7 to 20 carbon atoms in a main chain portion is more preferably used.

If the straight chain aliphatic diol is used as the aliphatic diol, the crystallinity of polyester can be retained, and decrease of the melting temperature of the polyester can be suppressed. Therefore, the straight chain aliphatic diol is preferably used from the viewpoint of obtaining a two-component developer excellent in toner blocking resistance, image storage stability and low-temperature fixability. Besides, the main chain portion of the straight chain aliphatic diol has preferably 7 to 20 carbon atoms because a melting point of a product of condensation polymerization with an aromatic dicarboxylic acid can be thus suppressed to be low, so as to realize low-temperature fixation. Furthermore, such a material is practically easily available. From these points of view, the main chain portion more preferably has 7 to 14 carbon atoms.

Examples of the aliphatic diols suitably used for synthesis of the crystalline polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosadecanediol. Among these, 1,8-octanediol, 1,9-nonanediol or 1,10-decanediol is preferably used from the viewpoint of availability.

Examples of the tri- or higher-hydric alcohols include glycerin, trimethylolethane, trimethylolpropane and pentaerythritol.

The crystalline polyester resin is preferably a hybrid crystalline polyester resin from the viewpoint of improving the flow ability of the toner in a toner bottle.

The hybrid crystalline polyester resin has a structure in which an amorphous other polymerized segment and a crystalline polyester polymerized segment are chemically bonded to each other. The another polymerized segment may be any resin different from the crystalline polyester polymerized segment, and examples include an amorphous polyester polymerized segment and a vinyl-based polymerized segment. Among these, the vinyl-based polymerized segment is preferred. Besides, the hybrid crystalline polyester resin may further contain another polymerized segment, such as a crystalline acrylic acid segment, in addition to the above-described polymerized segments as long as the effects of the present embodiment can be exhibited.

The molecular structure of the hybrid crystalline polyester resin is not limited, and for example, the resin may be a graft copolymer containing a vinyl-based polymerized segment as a main chain (a trunk) and a crystalline polyester polymerized segment as a side chain (a branch), or these polymerized segments may be linearly connected to each other.

The crystalline polyester polymerized segment corresponds to a portion, of the hybrid crystalline polyester resin, derived from crystalline polyester. The another polymerized segment corresponds to a portion, of the hybrid crystalline polyester resin, derived from another resin, and for example, in using a vinyl-based polymerized segment, corresponds to a portion, of the hybrid crystalline resin, derived from a vinyl-based resin.

More specifically, the crystalline polyester polymerized segment corresponds to a portion derived from crystalline polyester bonding to a main chain constituted by the another resin (such as the vinyl-based resin) or bonded to a side chain constituted by the another resin, and the another polymerized segment corresponds to a portion derived from the another resin bonding to the main chain constituted by the crystalline polyester or bonded to the side chain constituted by the crystalline polyester.

The amorphous polyester resin has a structure of a condensation polymer of, for example, a polycarboxylic acid and a polyhydric alcohol. The amorphous polyester resin may be a commercially available product or a synthesized product.

The amorphous polyester resin is preferably a hybrid amorphous polyester resin constituted by an amorphous polyester polymerized segment and another polymerized segment chemically bonding thereto from the viewpoint of improving the flow ability of the toner in a toner bottle. The another polymerized segment of the hybrid amorphous polyester resin is equivalent to that of the above-described hybrid crystalline polyester resin, and in particular, is preferably a vinyl-based polymerized segment.

Examples of the polycarboxylic acid include aromatic carboxylic acids such as terephthalic acid, isophthalic acid, phthalic anhydride, trimellitic anhydride, pyromellitic acid and naphthalenedicarboxylic acid; aliphatic carboxylic acids such as maleic anhydride, fumaric acid, succinic acid, alkenyl succinic anhydride and adipic acid; alicyclic carboxylic acids such as cyclohexanedicarboxylic acid; anhydrides of these; and lower alkyl esters (having 1 or more and 5 or less carbon atoms) of these. Among these polycarboxylic acids, the aromatic carboxylic acids are preferably used.

From the viewpoint of improving fixability of the toner, a dicarboxylic acid may be used together with a tri- or higher-valent carboxylic acid having a crosslinked structure or a branched structure (such as trimellitic acid and acid anhydride thereof) as the polycarboxylic acid. One or more of these polycarboxylic acids may be used.

Examples of the polyhydric alcohol include aliphatic diols such as ethylene glycol, diethylene glycol, triethylene glycol, propylene glycol, butanediol, hexanediol, neopentyl glycol and glycerin; alicyclic diols such as cyclohexanediol, cyclohexanedimethanol and hydrogenated bisphenol A; and aromatic diols such as an ethylene oxide adduct of bisphenol A and propylene oxide adduct of bisphenol A. Among these, the aromatic diols and alicyclic diols are more preferred, and the aromatic diols are further more preferred.

From the viewpoint of improving the fixability of the toner, a diol may be used together with a tri- or higher-hydric alcohol having a crosslinked structure or a branched structure (such as glycerin, trimethylolpropane or pentaerythritol) as the polyhydric alcohol. One or more of these polyhydric alcohols may be used.

The structures and the amounts of the main chains and the side chains of the crystalline polyester resin and the amorphous polyester resin can be confirmed or estimated by analyzing, for example, the binder resin or a hydrolysate thereof by a known instrumental analysis method such as nuclear magnetic resonance (NMR) or electrospray ionization mass spectrometry (ESI-MS).

Moreover, into the hybrid crystalline polyester resin or the hybrid amorphous polyester resin, a substituent such as a sulfonic acid group, a carboxyl group or a urethane group can be further introduced. The substituent may be introduced into the polyester polymerized segment or the vinyl-based polymerized segment.

A content of the crystalline or amorphous polyester polymerized segment in the hybrid crystalline polyester resin or the hybrid amorphous polyester resin can be appropriately determined as long as the effects of the present embodiment can be obtained. For example, if the content of the polyester polymerized segment in the hybrid crystalline polyester resin is too small, the low-temperature fixability may become insufficient in some cases, and if it is too large, high-temperature storage stability may become insufficient in some cases. Accordingly, the content is preferably 60 to 97 mass %, and more preferably 80 to 95 mass %.

A content of the another polymerized segment in the hybrid crystalline polyester resin or the hybrid amorphous polyester resin can be appropriately determined as long as the effects of the present embodiment can be obtained. For example, if the content of the vinyl-based polymerized segment in the hybrid crystalline polyester resin is too small, fracture resistance may become insufficient in some cases, and if it is too large, the low-temperature fixability may become insufficient in some cases. Accordingly, the content is preferably 3 to 40 mass %, and is more preferably 5 to 20 mass % from the viewpoint of improving the high-temperature storage stability and charge evenness.

The toner base particle may further contain another component in addition to the crystalline polyester resin and the amorphous polyester resin described above as long as the effects of the present embodiment can be obtained. Examples of such an additional component include another binder resin different from the crystalline polyester resin and the amorphous polyester resin, a colorant, a charge control agent and a release agent. One or more of these additional components may be contained.

Examples of the another binder resin include styrene-(meth)acrylic-based resins and partially modified polyester resins.

The styrene-(meth)acrylic-based resins have a molecular structure of a radical polymer of a compound having a radically polymerizable unsaturated bond, and can be synthesized by, for example, radical polymerization of the compound. One or more compounds may be used as the compound, and examples include styrene and derivatives thereof, and (meth)acrylic acids and derivatives thereof.

Examples of the styrene and derivatives thereof include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

Examples of the (meth)acrylic acids and derivatives thereof include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Incidentally, a monomer component used in synthesizing any of the above-described various binder resins may contain a chain transfer agent for adjusting the molecular weight of the resin to be obtained. One or more chain transfer agents may be contained, and the chain transfer agent is used in an amount capable of achieving the above-described object as long as the effects of the present embodiment can be exhibited. Examples of the chain transfer agent include 2-chloroethanol, mercaptans such as octyl mercaptan, dodecyl mercaptan and t-dodecyl mercaptan, and styrene dimers.

As the colorant, any of known colorants can be used. A content of the colorant in the toner base particle is preferably 1 to 10 parts by mass, and more preferably 2 to 8 parts by mass relative to 100 parts by mass of the binder resin.

Specifically, examples of the colorant for a yellow toner include C.I. solvent yellow 19, 44, 77, 79, 81, 82, 93, 98, 103, 104, 112 and 162, and C.I. pigment yellow 14, 17, 74, 93, 94, 138, 155, 180 and 185. Among these, C.I. pigment yellow 74 is preferably used.

Examples of the colorant for a magenta toner include C.I. solvent red 1, 49, 52, 58, 63, 111 and 122, and C.I. pigment red 5, 48:1, 53:1, 57:1, 122, 139, 144, 149, 166, 177, 178 and 222. Among these, C.I. pigment red 122 is preferably used.

An example of the colorant for a cyan toner includes C.I. pigment blue 15:3.

Examples of the colorant for a black toner include carbon black, a magnetic material and titanium black. Examples of the carbon black include channel black, furnace black, acetylene black, thermal black and lamp black. Examples of the magnetic material include ferromagnetic metals such as iron, nickel and cobalt, alloys containing any of these ferromagnetic metals, compounds of the ferromagnetic metals such as ferrite and magnetite, and alloys not containing the ferromagnetic metals but exhibiting ferromagnetism when heated. Examples of the alloys exhibiting ferromagnetism when heated include Heusler alloys such as manganese-copper-aluminum and manganese-copper-tin, and chromium dioxide.

The charge control agent refers to a material capable of imparting a positive or negative charge through frictional charging. As the charge control agent, any of various known positive charge control agents and negative charge control agents can be used. A content of the charge control agent in the toner base particle is preferably 0.01 to 30 parts by mass, and more preferably 0.1 to 10 parts by mass relative to 100 parts by mass of the binder resin.

As the release agent, any of various known waxes can be used. A content of the release agent in the toner base particle is preferably 0.1 to 30 parts by mass, and more preferably 1 to 10 parts by mass relative to 100 parts by mass of the binder resin.

Examples of the waxes include branched chain hydrocarbon waxes such as polyolefin waxes like polyethylene wax and polypropylene wax, and microcrystalline waxes; long chain hydrocarbon waxes such as paraffin wax and Sasol wax; dialkyl ketone waxes such as distearyl ketone, carnauba wax, montan wax, and ester waxes such as behenyl behenate, trimethylolpropane behenate, pentaerythritol tetrabehenate, pentaerythtritol diacetate dibehenate, glycerin tribehenate, 1,18-octadecanediol distearate, tristearyl trimellitate and distearyl maleate; and amide waxes such as ethylenediamine behenylamide and tristearylamide trimellitate.

The external additive contains a silica particle and a fatty acid metal salt particle.

The silica particle has a volume average particle size of 70 nm or more and 300 nm or less. If the volume average particle size of the silica particle is smaller than 70 nm, a distance between toner base particles cannot be suitably retained, and hence the bottle dischargeability and the transferability may become insufficient in some cases. If the volume average particle size of the silica particle is larger than 300 nm, the silica particle is liable to be detached from the toner base particle, and hence, if the toner bottle is stored or used for a long period of time, the flow ability of the toner particle is degraded due to the detachment of the silica particle, which may make the bottle dischargeability degraded and insufficient in some cases.

The volume average particle size of the silica particle can be obtained as follows: One hundred primary particles of the silica particle disposed on the toner base particle are observed with a scanning electron microscope (SEM), the largest diameter and the shortest diameter of an individual silica particle are measured by image analysis of the observed primary particles, a median of these diameters are used to obtain a sphere equivalent diameter, and the volume average particle size can be obtained as a diameter (D50v) at a cumulative frequency of 50% of the thus obtained sphere equivalent diameters. The volume average particle size of the silica particle can be adjusted by, for example, grinding a coarse product, classification or mixing with a classified product.

The silica particle has an average circularity of 0.5 or higher and 0.9 or lower. If the average circularity of the silica particle is lower than 0.5, the distance between toner base particles in the toner cannot be suitably retained, and hence the flow ability of the toner may become insufficient, resulting in insufficient bottle dischargeability. On the other hand, if the average circularity of the silica particle is higher than 0.9, the silica particle is liable to be detached from the toner base particle, and if the toner bottle is stored or used for a long period of time, the bottle dischargeability may be degraded to be insufficient in some cases.

The average circularity of the silica particle is obtained as follows: The primary particle of the silica particle disposed on the toner base particle is observed with an SEM, and on the basis of image analysis of the observed primary particle, a circularity "100/SF2" calculated in accordance with the following equation is obtained. In the equation, I represents a perimeter of the primary particle of the silica particle in the image, A represents a projected area of the primary particle of the silica particle, and SF2 represents a shape factor.

$$\text{Circularity}(100/SF2)=4\pi\times(A/I^2)$$

The average circularity of the silica particle is obtained as a circularity at a cumulative frequency of 50% of sphere equivalent diameters of 100 primary particles obtained through the above-described image analysis. The average circularity of the silica particle can be adjusted by producing the silica particle by a production method described later. Alternatively, among various commercially available silica particles produced by a sol-gel method, a silica particle having the desired circularity can be selectively obtained.

The silica particle may be any particle containing silica, namely, $SiO_2$, as a principal component, and may be crystalline or amorphous. Alternatively, the silica particle may be a particle produced from a silicon compound such as aqueous glass or alkoxysilane, or a particle obtained by grinding quartz. The silica particle produced from a silicon compound generally forms a secondary particle, that is, agglomeration of primary particles, and can be easily controlled into a desired shape ranging from a true sphere to a non-sphere. Therefore, the silica particle is preferably a silica particle produced by the sol-gel method. The silica particle produced by the sol-gel method has a porous structure owing to the agglomeration of primary particles, which characteristic can be confirmed by the observation with an SEM or the like.

Besides, from the viewpoint of dispersibility of the silica particle, the surface of the silica particle is preferably hydrophobized. The silica particle is hydrophobized by, for example, modification of the surface thereof with an alkyl group. For this purpose, a known organic silicon compound having an alkyl group may be caused to work on the silica particle. The method of the hydrophobization will be described in detail later.

The silica particle is preferably hydrophobized with an alkylalkoxysilane compound represented by the following formula from the viewpoint of the environmental stability of the silica particle. In the following formula, $R_1$ represents an optionally substituted straight chain $C_{4-16}$ alkyl group, and $R_2$ independently represents a methyl group or an ethyl group.

$$R_1—Si(OR_2)_3$$

Examples of the alkylalkoxysilane compound include octyltrimethoxysilane, isobutyltrimethoxysilane, hexadecane trimethoxysilane, hexamethyldisilazane, normal butyl trimethoxysilane, normal propyl trimethoxysilane, hexyltrimethoxysilane, decyltrimethoxysilane and dodecyltrimethoxysilane. Among these, hexamethyldisilazane is preferred.

The silica particle hydrophobized with the alkylalkoxysilane compound contains a silica particle and an alkyl group chemically bonded, at one end thereof, to the surface of the silica particle. The alkyl group chemically bonds to the silica particle via an alkoxysilane residue.

The silica particle may be produced by a dry method in which a silica particle having a particle size larger than 200 nm is ground and classified, or what is called a wet method in which the particle is generated by the sol-gel method using a silicon compound such as alkoxysilane as a material. As another wet method different from the sol-gel method, a method for obtaining a silica sol by using aqueous glass as a material may be employed for producing the silica particle. In order to obtain the silica particle having the average circularity of 0.50 or higher and 0.90 or lower, the silica particle is preferably produced by the sol-gel method, and also from the viewpoint of inhibiting foaming from occurring in a fixed image in fixing the toner, the silica particle is preferably produced by the sol-gel method in which a water component is difficult to retain.

As one preferable production method for the silica particle, a method for producing the silica particle by the sol-gel method will now be described.

This production method includes a preparation step of preparing an alkaline catalyst solution containing an alkaline catalyst in a solvent containing alcohol; a first supplying step of supplying, into the alkaline catalyst solution, tetraalkoxysilane and an alkaline catalyst until a supply amount of the tetraalkoxysilane is 0.002 mol/mol or more and 0.008 mol/mol or less based on an amount of the alcohol used in the preparation step; a supply stopping step, performed after the first supplying step, of stopping supply of the tetraalkoxysilane and the alkaline catalyst for 0.5 minutes or more and 10 minutes or less; and a second supplying step, performed after the supply stopping step, of further supplying the tetraalkoxysilane and the alkaline catalyst into the alkaline catalyst solution.

Specifically, in the above-described production method, the tetraalkoxysilane used as a material and the alkaline catalyst used as a catalyst are respectively supplied in the presence of alcohol contained in the alkaline catalyst, and during a reaction of the tetraalkoxysilane, the supply of these is stopped at least once, and thereafter, the supply is resumed so as to generate a deformed silica particle in a flat shape.

Through the above-described production method, a substantially spherical silica particle having an average circularity of 0.50 or higher and 0.90 or lower can be obtained. The reason is not clear but is presumed as follows:

First, an alkaline catalyst solution containing an alkaline catalyst in a solvent containing alcohol is prepared, and tetraalkoxysilane and an alkaline catalyst are respectively supplied into the solution. Thus, the tetraalkoxysilane supplied into the alkaline catalyst solution is reacted to generate a nuclear particle. At this point, the alkaline catalyst not only works as a catalyst but also is configured on a surface of the generated nuclear particle to be contributive to shape and dispersion stability of the nuclear particle. Since the alkaline catalyst does not, however, uniformly cover the surface of the nuclear particle (namely, the alkaline catalyst unevenly adheres to the surface of the nuclear particle), although the dispersion stability of the nuclear particle is retained, surface tension and chemical affinity of the nuclear particle are partially deviated. This is probably the reason why a deformed nuclear particle is generated.

When the supply of the tetraalkoxysilane and the alkaline catalyst is continued, the generated nuclear particle grows through the reaction of the tetraalkoxysilane. Here, when the supply amount of the tetraalkoxysilane reaches the above-described specific concentration, the supply of the tetraalkoxysilane and the alkaline catalyst is stopped for the above-described specific time duration, and thereafter, the supply is resumed.

When the supply of the tetraalkoxysilane and the alkaline catalyst is stopped, particles present in the reaction system agglomerate into a flat shape. Here, if the supply of the tetraalkoxysilane and the alkaline catalyst is stopped too early, namely, if the supply amount of the tetraalkoxysilane is small, the concentration of particles in the reaction system is so low that there is a low possibility that the particles collide with one another, and hence the agglomeration is probably difficult to proceed.

On the other hand, if the supply of the tetraalkoxysilane and the alkaline catalyst is stopped too late and the supply amount of the tetraalkoxysilane is large, the nuclear particle grows too much, the particles themselves are stabilized and hence do not agglomerate, and therefore, a particle in a flat shape may not be formed in some cases. Besides, if the time when the supply of the tetraalkoxysilane and the alkaline catalyst is stopped is too short, an amount of agglomerated particles is insufficient, and on the contrary, if the time is too long, particles are liable to agglomerate too much and hence a gel is formed.

Furthermore, the deformed silica particle is flattened in the supply stopping step, and then, the supply of the tetraalkoxysilane and the alkaline catalyst is resumed to proceed the particle growth, and thus, the silica particle in a substantially spherical shape having an average circularity of 0.50 or higher and 0.90 or lower can be obtained.

Besides, since the deformed nuclear particle is generated and grown with the deformed shape kept so as to generate the silica particle in the above-described production method, it is presumed that the silica particle in a substantially spherical shape having high shape stability against mechanical load can be obtained. In addition, since the particle is grown with the deformed shape of the generated deformed nuclear particle kept to obtain the silica particle in the above-described production method, it is presumed that the silica particle resistant to the mechanical load and difficult to break can be obtained.

Moreover, since the particle is generated by respectively supplying the tetraalkoxysilane and the alkaline catalyst into the alkaline catalyst solution to cause the reaction of the tetraalkoxysilane in the above-described production method, the total use amount of the alkaline catalyst is small as compared with a case where a substantially spherical silica particle is produced by the conventional sol-gel method. As a result, a step of removing the alkaline catalyst can be omitted. This is particularly advantageous when the silica particle is applied to a product required of high purity.

Now, this production method will be described in more detail.

The production method is roughly divided into two main steps, one of which is a step of preparing an alkaline catalyst solution (a preparation step) and the other of which is a step of generating a silica particle by supplying tetraalkoxysilane and an alkaline catalyst into the alkaline catalyst solution (a particle generation step).

The particle generation step is further divided into at least three stages, and includes a first supplying step of supplying the tetraalkoxysilane and the alkaline catalyst into the alkaline catalyst solution to start generation of a silica particle, a supply stopping step (also designated as an aging step) of stopping the supply of the tetraalkoxysilane and the alkaline catalyst, and a second supplying step, performed thereafter, of resuming the supply of the tetraalkoxysilane and the alkaline catalyst.

[Preparation Step]

In the preparation step, a solvent containing alcohol is prepared, and an alkaline catalyst is added thereto to prepare an alkaline catalyst solution.

The solvent containing alcohol may be a solvent made of alcohol alone, or may be a mixed solvent, if necessary, with water or another solvent, for example, a ketone such as acetone, methyl ethyl ketone or methyl isobutyl ketone, a cellosolve such as methyl cellosolve, ethyl cellosolve, butyl cellosolve or cellosolve acetate, or an ether such as dioxane or tetrahydrofuran. If a mixed solvent is used, an amount ratio of alcohol to another solvent may be 80 mass % or more (preferably 90 mass % or more). Examples of the alcohol include lower alcohols such as methanol and ethanol.

The alkaline catalyst is a catalyst for accelerating a reaction (hydrolysis or condensation) of the tetraalkoxysilane. Examples of the alkaline catalyst include ammonia, urea, monoamine and quaternary ammonium salt. Among these, ammonia is preferably used.

A concentration (a content) of the alkaline catalyst is preferably 0.62 mol/L or more and 0.7 mol/L or less, and more preferably 0.64 mol/L or more and 0.67 mol/L or less. It is noted that the concentration of the alkaline catalyst refers to a concentration in the alcohol catalyst solution (namely, the solution containing the alkaline catalyst and the solvent containing alcohol).

If the concentration of the alkaline catalyst falls in the above-described range, dispersibility of a nuclear particle generated and growing when tetraalkoxysilane is supplied in the particle generation step can be easily stabilized. Therefore, generation of a coarse agglomerate like a secondary agglomerate can be inhibited so as to inhibit gelation, and hence, a preferable particle size can be easily attained.

[Particle Generation Step]

Next, the particle generation step will be described. In the particle generation step, tetraalkoxysilane and an alkaline catalyst are supplied into the alkaline catalyst solution, and the reaction (hydrolysis or condensation) of the tetraalkoxysilane is caused in the alkaline catalyst solution to generate a silica particle. In the method for producing a silica particle of the present embodiment, during the growth of the particle, the supply of the components to be added is stopped to cause agglomeration to form a deformed particle in a flat shape.

(First Supplying Step)

In the first supplying step, the tetraalkoxysilane and the alkaline catalyst are supplied into the alkaline catalyst solution. The tetraalkoxysilane is supplied up to a concentration of 0.002 mol/mol or more and 0.008 mol/mol or less based on the amount of alcohol used in the preparation step.

Here, the term "concentration of 0.002 mol/mol or more and 0.008 mol/mol or less based on the amount of alcohol used in the preparation step" means "a concentration of 0.002 mol/mol or more and 0.008 mol/mol or less based on a unit molar amount (1 mol) of the alcohol contained in the alkaline catalyst solution prepared in the preparation step".

If the supply amount of the tetraalkoxysilane in the first supplying step is smaller than 0.002 mol/mol based on the amount of the alcohol contained in the alkaline catalyst solution prepared in the preparation step, since a particle concentration attained in the formation of a nuclear particle is low, coalescence of particles does not proceed, and hence a particle with a low deformation degree is formed, and flow ability retention may be impaired in some cases. On the other hand, if the supply amount of the tetraalkoxysilane is larger than 0.008 mol/mol based on the amount of the alcohol contained in the alkaline catalyst solution prepared in the preparation step, since a nuclear particle is stabilized, the coalescence of particles does not proceed, and hence a particle with a low deformation degree is formed, and the flow ability retention may be impaired in some cases.

The supply amount of the tetraalkoxysilane in the first supplying step is preferably 0.003 mol/mol or more and 0.008 mol/mol or less, and more preferably 0.006 mol/mol or more and 0.008 mol/mol or less based on the amount of the alcohol contained in the alkaline catalyst solution prepared in the preparation step.

Examples of the tetraalkoxysilane to be supplied into the alkaline catalyst solution include silane compounds such as tetrafunctional silane compounds, and specific examples include tetramethoxysilane, tetraethoxysilane, tetrapropoxysilane and tetrabutoxysilane. From the viewpoint of controllability of a reaction speed and the shape, the particle size and the particle size distribution of a silica particle to be obtained, tetramethoxysilane or tetraethoxysilane is preferably used.

In the first supplying step, at an initial stage of the supply of the tetraalkoxysilane and the alkaline catalyst, a nuclear particle is formed through the reaction of the tetraalkoxysilane (which is designated as a nuclear particle formation stage), and when these materials are further supplied, the nuclear particle grows (which is designated as a nuclear particle growth stage).

As described above, in the alkaline catalyst solution to which the tetraalkoxysilane and the alkaline catalyst are supplied, the concentration (the content) of the alkaline catalyst is preferably 0.6 mol/L or more and 0.85 mol/L or less.

Accordingly, the first supplying step preferably includes a nuclear particle forming step of forming a nuclear particle by supplying the tetraalkoxysilane and the alkaline catalyst into the alkaline catalyst solution containing the alkaline catalyst in a concentration of 0.6 mol/L or more and 0.85 mol/L or less. The preferable range of the concentration of the alkaline catalyst in the alkaline catalyst solution is described above.

A rate of supplying the tetraalkoxysilane is preferably 0.001 mol/(mol·min) or more and 0.010 mol/(mol·min) or less based on the amount of the alcohol contained in the alkaline catalyst solution. This rate means that the tetraalkoxysilane is supplied in an amount of 0.001 mol or more and 0.010 mol or less per minute based on 1 mol of the alcohol used in the step of preparing the alkaline catalyst solution.

If the supply rate of the tetraalkoxysilane falls in the above-described range, a silica particle in a substantially spherical shape having an average circularity of 0.75 or higher and 0.90 or lower can be readily generated at a high ratio (of, for example, 95% by number of more).

Incidentally, the particle size of the silica particle depends upon the type of tetraalkoxysilane to be used and reaction conditions, and for example, if the total supply amount of the tetraalkoxysilane used in the reaction for generating the particle is 1.08 mol or more per liter of a silica particle dispersion, a primary particle having a particle size of 70 nm or more can be obtained, if the total supply amount is 5.49 mol or less per liter of the silica particle dispersion, a primary particle having a particle size of 200 nm or less can be obtained.

If the supply rate of the tetraalkoxysilane is lower than 0.001 mol/(mol·min), the tetraalkoxysilane is homogeneously supplied to the nuclear particle before causing the reaction between the nuclear particle and the tetraalkoxysilane, and therefore, similar shaped silica particles uniform in the particle size and the shape may be generated in some cases. If the supply rate of the tetraalkoxysilane is 0.010 mol/(mol·min) or lower, the supply amount of the tetraalkoxysilane is not excessive for a reaction of the tetraalkoxysilane occurring in the nuclear particle formation stage and a reaction between the tetraalkoxysilane and the nuclear particle occurring during the particle growth, and hence, the reaction system is difficult to undergo gelation, and the formation of the nuclear particle and the growth of the particle are not easily inhibited.

The supply rate of the tetraalkoxysilane is preferably 0.0065 mol/(mol·min) or more and 0.0085 mol/(mol·min) or less, and more preferably 0.007 mol/(mol·min) or more and 0.008 mol/(mol·min) or less.

On the other hand, examples of the alkaline catalyst to be supplied to the alkaline catalyst solution are the same as those described above. The alkaline catalyst to be supplied may be the same as or different from, and is preferably the same as, the alkaline catalyst precedently contained in the alkaline catalyst solution.

A supply amount of the alkaline catalyst is preferably 0.1 mol or more and 0.4 mol or less, more preferably 0.14 mol or more and 0.35 mol or less, and further preferably 0.18 mol or more and 0.30 mol or less based on 1 mol of the total supply amount per minute of the tetraalkoxysilane.

If the supply amount of the alkaline catalyst is 0.1 mol or more, the dispersibility of the generated nuclear particle can be stabilized during the growth thereof, and hence a coarse agglomerate like a secondary agglomerate is difficult to generate so as to inhibit gelation. Besides, if the supply amount of the alkaline catalyst is 0.4 mol or less, the generated nuclear particle is difficult to become excessively stabilized, and the growth of the deformed nuclear particle formed at the nuclear particle generation stage can be inhibited from growing into a spherical shape in the nuclear particle growth stage.

(Supply Stopping Step (Aging Step))

After supplying the tetraalkoxysilane and the alkaline catalyst until the aforementioned concentration of the tetraalkoxysilane is attained in the first supplying step, in the supply stopping step, the supply of the tetraalkoxysilane and the alkaline catalyst is stopped for 0.5 minutes or more and 10 minutes or less. The supply stopping step is what is called an aging step in which the supply of the tetraalkoxysilane and the alkaline catalyst is once stopped to proceed the agglomeration of the nuclear particles for aging.

If the time of stopping supply of the tetraalkoxysilane and the alkaline catalyst is 0.5 minutes or more in the aging step, the coalescence of the particles sufficiently proceeds so as to form a particle with a high deformation degree. Besides, if the time of stopping supply of the tetraalkoxysilane and the alkaline catalyst is 10 minutes or less in the aging step, the coalescence of the particles is prevented from excessively proceeding so as not to impair the dispersion of the particles.

The time of stopping supply of the tetraalkoxysilane and the alkaline catalyst in the aging step is preferably 0.6 minutes or more and 5 minutes or less, and more preferably 0.8 minutes or more and 3 minutes or less.

(Second Supplying Step)

In the second supplying step, the tetraalkoxysilane and the alkaline catalyst are further supplied after the supply stopping step. The supply of the tetraalkoxysilane and the alkaline catalyst having been stopped in the supply stopping step is resumed, so as to grow the agglomerate of the nuclear particles for further increasing the volume average particle size of the flat and deformed silica particle.

In the second supplying step, the concentration and the supply amount of the tetraalkoxysilane supplied to the reaction system and the concentration and the supply amount of the alkaline catalyst are the same as those described with reference to the first supplying step. In the second supplying step, however, the concentration and the supply amount of the tetraalkoxysilane supplied to the reaction system and the concentration and the supply amount of the alkaline catalyst may be different from those of the tetraalkoxysilane and the alkaline catalyst supplied to the reaction system in the first supplying step.

Incidentally, in the particle generation step (including the first supplying step, the aging step and the second supplying step), the temperature (at the time of the supply) of the alkaline catalyst solution is, for example, preferably 5° C. or more and 50° C. or less, and more preferably 15° C. or more and 40° C. or less.

Besides, this method for producing the silica particle may include, after the second supplying step, one or more supply stopping steps, and further include a supplying step of further supplying the tetraalkoxysilane and the alkaline catalyst.

Through the above-described steps, the silica particle is obtained. The produced silica particle is obtained in the form of a dispersion, which may be directly used as a silica particle dispersion, or from which the silica particle may be taken out as a powder by removing the solvent.

If the resultant silica particle is used as the silica particle dispersion, the concentration of a solid component of the silica particle may be adjusted if necessary by diluting with water or alcohol, or by concentrating the dispersion. Alternatively, the silica particle dispersion may be used with the solvent substituted with any of water-soluble organic solvents such as alcohols, esters or ketones.

On the other hand, if the resultant silica particle is used in the form of a powder of the silica particle, it is necessary to remove the solvent from the silica particle dispersion. Examples of a method for removing the solvent include known methods such as 1) a method in which the solvent is removed by filtration, centrifugation or distillation and the resultant is dried using a vacuum dryer, a tray dryer or the like, and 2) a method in which a slurry is directly dried using a fluidized bed dryer, a spray dryer or the like. A drying temperature is not especially limited, and is preferably 200° C. or less. If the drying temperature is higher than 200° C., bonding of primary particles or generation of coarse particles is liable to occur due to condensation of a silanol group remaining on the surface of the silica particle.

From the dried silica particle, coarse particles and agglomerates are preferably removed by crushing or sieving if necessary. The crushing can be performed, for example, using a dry mill such as a jet mill, a vibration mill, a ball mill or a pin mill. The sieving can be performed, for example, using a known sieving apparatus such as a vibration sieve or an air sieve.

The surface of the silica particle obtained by this production method may be hydrophobized with a hydrophobic treatment agent before use. Examples of the hydrophobic treatment agent include known organic silicon compounds having an alkyl group (such as a methyl group, an ethyl group, a propyl group or a butyl group). Specific examples include silane compounds such as methyltrimethoxysilane, dimethyldimethoxysilane, trimethylchlorosilane and trimethylmethoxysilane, and silazane compounds such as hexamethyldisilazane and tetramethyldisilazane. One or more of these hydrophobic treatment agents may be used. Among these, an organic silicon compound having a trimethyl group, such as trimethylmethoxysilane or hexamethyldisilazane, is suitably used.

An amount of the hydrophobic treatment agent to be used can be appropriately determined as long as the hydrophobizing effect can be obtained, and is, for example, preferably 1 mass % or more and 100 mass % or less, and more preferably 5 mass % or more and 80 mass % or less based on the silica particle.

An example of a method for obtaining a hydrophobic silica particle dispersion having been subjected to the hydrophobization with a hydrophobic treatment agent includes a method in which the silica particle is hydrophobized by adding a necessary amount of the hydrophobic treatment agent to the silica particle dispersion to cause a reaction, with stirring, at a temperature of 30° C. or more and 80° C. or less. If the reaction temperature is lower than 30° C., the hydrophobization is difficult to proceed, and if the reaction temperature exceeds 80° C., gelation of the dispersion or agglomeration of the silica particles is liable to occur due to self-condensation of the hydrophobic treatment agent.

On the other hand, examples of a method for obtaining a powder of a hydrophobic silica particle include a method in which the hydrophobic silica particle dispersion obtained by the above-described method is dried by the method described above to obtain a powder of the hydrophobic silica particle, a method in which the silica particle dispersion is dried to obtain a powder of a hydrophilic silica particle, and a hydrophobic treatment agent is added to the powder for hydrophobization to obtain a powder of a hydrophobic silica particle, and a method in which the hydrophobic silica particle dispersion obtained as described above is dried to obtain a powder of a hydrophobic silica particle and a hydrophobic treatment agent is further added thereto for hydrophobization to obtain a powder of a hydrophobic silica particle.

An example of a method for hydrophobizing a powder of a silica particle includes a method in which a powder of a hydrophilic silica particle is stirred in a treatment tank such as a Henschel mixer or a fluidized bed, a hydrophobic treatment agent is added thereto, and the treatment tank is heated to gasify the hydrophobic treatment agent so as to cause a reaction with a silanol group on the surface of the silica particle contained in the powder. A treatment temperature to be employed in this method is, for example, preferably 80° C. or more and 300° C. or less, and more preferably 120° C. or more and 200° C. or less.

Next, the fatty acid metal salt particle used as the external additive will be described.

The fatty acid metal salt particle has a median diameter (D50s) based on the volume of 0.50 μm or more and 2.00 μm or less. If the median diameter of the fatty acid metal salt particle is smaller than 0.50 μm, lubricity of the toner particle becomes insufficient, and silica filming may occur in some cases. If the median diameter of the fatty acid metal salt particle is larger than 2.00 μm, the fatty acid metal salt particle is not held on the surface of the toner base particle, and hence its spacer effect for the toner base particle becomes insufficient for appropriately controlling the distance between the toner base particles. As a result, the bottle dischargeability may become insufficient in some cases, and the developability and the transferability may become insufficient in some cases.

The median diameter based on the volume of the fatty acid metal salt particle can be obtained in accordance with JIS Z8825-1 (2013). A specific measurement method is as follows.

As a measurement apparatus, a laser diffraction/scattering particle size distribution analyzer "LA-920" (manufactured by Horiba, Ltd.) is used. Software "HORIBA LA-920 for Windows (R) WET (LA-920) Ver. 2.02" attached to the analyzer LA-920 is used for setting measurement conditions and analyzing measurement data. Besides, ion-exchanged water from which solid impurities and the like are precedently removed is used as a measurement solvent.

The measurement includes the following procedures (1) to (11):

(1) A batch type cell holder is attached to the analyzer LA-920.

(2) A prescribed amount of ion-exchanged water is put in a batch type cell, and the batch type cell is set in the batch type cell holder.

(3) The content of the batch type cell is stirred using a specialized stirrer tip.

(4) A "Refractive Index" button on a "Condition Setting" screen is pressed to select a file "110A000I" (relative refractive index 1.10).

(5) In the "Condition Setting" screen, the base of the particle size measurement is set to volume base.

(6) After performing a warm-up operation for 1 hour or more, adjustment and fine adjustment of an optical axis, and blank measurement are performed.

(7) A 100 mL glass flat bottom beaker is charged with about 60 mL of ion-exchanged water. To the resultant beaker, about 0.3 mL of a diluted solution obtained by diluting "Contaminon N" (a 10 mass % aqueous solution of a neutral detergent for washing precision measuring instruments of pH 7 containing a nonionic surfactant, an anionic surfactant and an organic builder, manufactured by Wako Pure Chemical Industries Ltd.) about 3-fold in mass with ion-exchanged water is added.

(8) An ultrasonic disperser "Ultrasonic Dispersion System Tetora 150" (manufactured by Nikkaki Bios Co., Ltd.) with an electrical power output of 120 W in which two oscillators having an oscillation frequency of 50 kHz are disposed with their phases shifted by 180 degrees is prepared. A water tank of the ultrasonic disperser is charged with about 3.3 L of ion-exchanged water, and about 2 mL of Contaminon N is added into the water tank.

(9) The beaker of (7) described above is set in a beaker fixing hole of the ultrasonic disperser, and the ultrasonic disperser is actuated. Then, the position of the beaker is adjusted so that the liquid surface of the aqueous solution contained in the beaker can be placed in the maximum resonance state.

(10) With the aqueous solution contained in the beaker of (9) described above irradiated with ultrasonic waves, about 1 mg of the fatty acid metal salt particle is added in small aliquots to the aqueous solution in the beaker to be dispersed therein. Thereafter, the ultrasonic dispersion is continued for further 60 seconds. Here, although the fatty acid metal salt particle may float on the liquid surface in the form of a lump in some cases, the beaker is shaken to sink the lump in such a case before performing the ultrasonic dispersion for 60 seconds. Besides, in performing the ultrasonic dispersion, the temperature of the solution in the water tank is appropriately adjusted to 10° C. or more and 40° C. or less.

(11) The resultant aqueous solution in which the fatty acid metal salt particle is dispersed as described in (10) above is immediately added, in small aliquots, into the batch type cell carefully not to introduce bubbles, and the concentration of the dispersion obtained as described above is adjusted so as to attain transmittance of light emitted from a tungsten lump of 90% to 95%. Then, a particle size distribution is measured. On the basis of data of the particle size distribution based on the volume thus obtained, a 50% volume-cumulative particle size is obtained, which is defined as the median diameter based on the volume of the fatty acid metal salt particle.

The fatty acid metal salt particle is, for example, a particle made of a fatty acid metal salt itself, and examples of the fatty acid include monovalent saturated fatty acids such as butanoic acid, valeric acid, lauric acid, myristic acid, palmitic acid, stearic acid and montanic acid, polyvalent saturated fatty acids such as adipic acid, pimelic acid, suberic acid, azelaic acid and sebacic acid, monovalent unsaturated fatty acids such as crotonic acid and oleic acid, and polyvalent unsaturated fatty acids such as maleic acid and citraconic acid. One or more of these fatty acids may be used.

The fatty acid of the fatty acid metal salt is preferably a fatty acid having 12 or more and 30 or less carbon atoms, and more preferably a fatty acid having 18 or more and 24 or less carbon atoms. From the viewpoint of improving chargeability of the fatty acid metal salt particle so as to effectively cause the fatty acid metal salt particle to electrostatically adhere to the toner base particle, the fatty acid has preferably 12 or more carbon atoms, and more preferably 18 or more carbon atoms. Besides, the carbon number is preferably 12 or more because release of the fatty acid from the fatty acid metal salt can be thus easily inhibited.

The carbon number of the fatty acid is preferably 30 or less, and more preferably 24 or less from the viewpoint of attaining a sharp charge distribution of the toner. In particular, the fatty acid metal salt is further more preferably a stearic acid metal salt because a rise in charging the toner can be thus made steeper, and the aforementioned effect can be further improved.

Many of fatty acids present in nature are mixtures of acid components having different carbon numbers. For example, a stearic acid found in nature contains, as a principal component, a stearic acid having 18 carbon atoms, and in addition, contains small amounts of fatty acid components, for example, having 14 carbon atoms, 16 carbon atoms, 20 carbon atoms and 22 carbon atoms, respectively. In general, a stearic acid having a purity of the fatty acid component of the principal component improved through purification to some extent is industrially distributed. As a product with a higher purity, a product of Japanese pharmacopoeia grade is available. The fatty acid may contain a fatty acid having a carbon number different from the desired carbon number as long as the effects of the present embodiment can be obtained, but from the viewpoint of obtaining the effects, a purified product obtained through the purification is preferably used, and a highly purified product is more preferably used.

If stearic acid is used as the fatty acid, the purity of the fatty acid is preferably 90.0 mass % or more and 99.9 mass % or less, and more preferably 95.0 mass % or more and 99.9 mass % or less as the whole. If the purity of the fatty acid is lower than 90.0 mass %, heat resistance of the fatty acid metal salt particle is degraded, and hence raw materials are solidified in a vessel or difficult to handle during the production. Besides, the increase of the purity of the fatty acid beyond 99.9 mass % may increase purification cost in some cases. Incidentally, the purity of the fatty acid herein means a purity as the fatty acid component in the aforementioned case, and organic or inorganic substances excluding the fatty acid are regarded as impurities.

Examples of a principal metal constituting the salt in the fatty acid metal salt include lithium, sodium, potassium, copper, rubinium, silver, zinc, magnesium, calcium, strontium, aluminum, iron, cobalt and nickel. From the viewpoint of keeping the chargeability of the toner in a suitable range for a long period of time, the metal is preferably zinc or calcium. Besides, another metal may be contained in addition to the principal metal. In such a case, an elemental ratio of another metal (i.e., a ratio of another metal in the whole metal) is preferably lower than 30%.

The fatty acid metal salt is particularly preferably zinc stearate or calcium stearate.

A content of a free fatty acid in the fatty acid metal salt is preferably 0.20 mass % or less. If the content of the free fatty acid exceeds 0.20 mass %, the effect otherwise exhibited by the fatty acid metal salt may become insufficient in some cases.

The content of the free fatty acid in the fatty acid metal salt can be obtained as follows: One g of a sample of the fatty acid metal salt is precisely weighed to be dissolved in a 1:1 mixture of ethanol and ethyl ether, and the resultant is subjected to neutralization titration in a potassium hydroxide aqueous solution with phenolphthalein used as an indicator. On the basis of the thus obtained result, a content of a free fatty acid in all fatty acids contained in the fatty acid metal salt is obtained as a mass percentage.

The fatty acid metal salt has a melting point of preferably 122.0° C. or higher and lower than 130.0° C. If the melting point of the fatty acid metal salt is lower than 122.0° C., the toner is liable to adhere to a toner stirring blade provided in a developer container or in the vicinity of a bearing of a developing roller, or the fatty acid metal salt is liable to fuse on a mixing blade during the production. Besides, a fatty acid metal salt having a low melting point generally has a low purity of a fatty acid raw material contained in the fatty acid, and is liable to contain another low molecular weight component as an impurity. On the other hand, if the melting point of the fatty acid metal salt is 130.0° C. or higher, the toner filming may occur on a toner conveyance member in an image forming apparatus in some cases.

The melting point of the fatty acid metal salt is measured using a differential scanning calorimeter "Q1000" (manufactured by TA Instruments) in accordance with ASTM D3418-82. The melting points of indium and zinc are used for temperature calibration of a detecting section of the calorimeter, and the heat of fusion of indium is used for calibration of the amount of heat. Specifically, about 10 mg of a sample is precisely weighed to be put in an aluminum pan, and the measurement is performed within a measurement temperature range of 30 to 200° C. at a temperature rise rate of 10° C./min, with an empty aluminum pan used as a reference. It is noted that the melting point of the fatty acid metal salt corresponds to a temperature of the endothermic peak obtained by the 1ST scan.

A content of the fatty acid metal salt in 100 parts by mass of the toner particle is preferably 0.02 parts by mass or more and 1.00 parts by mass or less, and more preferably 0.05 parts by mass or more and 0.50 parts by mass or less. If the content of the fatty acid metal salt is smaller than 0.02 parts by mass, the toner filming may occur on a toner conveyance member in an image forming apparatus in some cases. If the content of the fatty acid metal salt exceeds 1.00 part by mass, dripping of the toner is liable to occur within a developer container.

The contents of the silica particle and the fatty acid metal salt particle preferably satisfy the following formula. In the following formula, X represents the content (in parts by mass) of the fatty acid metal salt particle relative to 100 parts by mass of the toner base particle, and Y represents the content (in parts by mass) of the silica particle relative to 100 parts by mass of the toner base particle.

$$0.025 \leq X/Y \leq 0.075$$

In this formula, X/Y corresponds to a ratio of the content of the fatty acid metal salt particle to the content of the silica particle in the toner particle. If the ratio X/Y is too small, the silica filming may occur in some cases, and if the ratio X/Y is too large, filming of the fatty acid metal salt particle may occur in some cases.

Representative examples of a method for producing the fatty acid metal salt particle include a method in which a reaction is caused by adding, in a dropwise manner, a solution of an inorganic metal compound to a solution of an alkali metal salt of a fatty acid (a metathesis method), and a method in which a reaction is caused by kneading a fatty acid and an inorganic metal compound at a high temperature (a fusion method). The production method for the fatty acid metal salt particle is preferably a wet method because variation in the size and the shape among the particles of a fatty acid metal salt can be small in employing this method, and the metathesis method is particularly preferred. The metathesis method includes a step of substituting an alkali metal of a fatty acid by a metal of an inorganic metal compound by adding, in a dropwise manner, a solution of the inorganic metal compound to a solution of the alkali metal salt of the fatty acid.

The toner may further contain another component in addition to the toner base particle, the silica particle and the fatty acid metal salt particle described above as long as the effects of the present embodiment can be exhibited. An example of the additional component includes another external additive used for improving the flow ability or the chargeability of the toner, and this another external additive is, for example, an inorganic fine particle. Examples of the inorganic fine particle include inorganic oxide fine particles such as a silica fine particle, an alumina fine particle and a titanium oxide fine particle, and inorganic titanate compound fine particles of strontium titanate and zinc titanate, all having a volume average particle size smaller than 30 nm. The volume average particle size of the inorganic oxide fine particle is preferably 10 nm or more. The volume average particle size of the inorganic oxide fine particle can be obtained in the same manner as that of the silica particle.

Among the above-described external additives used in the toner, an inorganic oxide-based external additive preferably has a surface hydrophobized with a known surface treating agent such as a coupling agent from the viewpoint of high-temperature storage and environmental stability. An external additive having a hydrophobized surface contains a particle of the external additive, and a surface treating agent or a residue thereof born on the surface of the particle. The surface treating agent itself is physically born on the surface of the particle of the external additive, and the residue is born on the surface of the particle of the external agent through a chemical reaction between the surface treating agent and the surface of the external additive.

Examples of the surface treating agent include dimethyldimethoxysilane, hexamethyldisilazane (HMDS), methyltrimethoxysilane, isobutyltrimethoxysilane and decyltrimethoxysilane.

The surface treating agent may be silicone oil. Examples of the silicone oil include cyclic organosiloxanes such as organosiloxane oligomer, octamethylcyclotetrasiloxane, decamethylcyclopentasiloxane, tetramethylcyclotetrasiloxane and tetravinyltetramethylcyclotetrasiloxane, and linear or branched organosiloxanes.

The silicone oil may be a modified silicone oil. The modified silicone oil is a highly reactive silicone oil, for example, in which a modification group is introduced into one or both of ends of one or both of a main chain and a side chain. Examples of the modification group include alkoxy, carboxyl, carbinol, higher fatty acid, phenol, epoxy, methacrylic and amino groups. Besides, the modified silicone oil may have a plurality of modification groups as in amino/alkoxy-modification.

Two or more of the above-described surface treating agents may be used together. The surface treating agent may be, for example, a dimethyl silicone oil and the modified silicone oil, or may further contain another surface treating agent. Surface treating agents to be used together may be mixed with each other before use, or may be independently used. Examples of the surface treating agent additionally used as described above include a silane coupling agent excluding those mentioned above, a titanate-based coupling agent, an aluminate-based coupling agent, any of various silicone oils excluding those mentioned above, a fatty acid, a fatty acid metal salt excluding those mentioned above, an esterified product thereof, and rosin acid.

The toner particle contains the toner base particle and the external additive as described above, and can be directly used as a one-component developer. If the toner further contains a carrier particle, a two-component developer can be obtained.

The carrier particle contains a magnetic particle. Examples of the carrier particle include a carrier particle containing a magnetic particle alone, a resin-coated carrier particle containing a magnetic particle and a resin layer coating its surface, and a resin dispersion carrier particle containing a resin particle in which a magnetic particle is dispersed.

The carrier particle has a true specific gravity of preferably 4.25 to 5 g/cm$^3$ and a porosity of preferably 8% or less. For realizing these physical properties, the carrier particle is preferably the resin-coated carrier particle. It is noted that the carrier particle may contain an internal additive such as a resistance modifier if necessary.

Examples of the magnetic particle include a metal powder such as an iron powder and various ferrite particles. Among these, a ferrite particle is preferably used.

Examples of ferrite include a ferrite containing a heavy metal such as copper, zinc, nickel or manganese, and a ferrite containing a light metal such as an alkali metal or an alkaline earth metal, both of which are preferably used.

The ferrite is a compound represented by the following formula. A molar ratio y of $Fe_2O_3$ constituting the ferrite is preferably 30 to 95 mol %. If the composition ratio y falls in this range, such a ferrite is easily magnetized as desired, and hence has a merit, for example, that carrier adhesion is difficult to occur.

$$(MO)_x(Fe_2O_3)_y \qquad \text{Formula:}$$

In this formula, M represents at least one metal atom selected from the group consisting of manganese (Mn), magnesium (Mg), strontium (Sr), calcium (Ca), titanium (Ti), copper (Cu), zinc (Zn), nickel (Ni), aluminum (Al), silicon (Si), zirconium (Zr), bismuth (Bi), cobalt (Co) and lithium (Li).

A resin used for forming the resin layer is, for example, an acrylic resin, and an example of the acrylic resin includes a radical polymer containing an alicyclic methacrylic acid ester as a monomer. The alicyclic methacrylic acid ester is generally highly hydrophobic, and hence, water absorption of the resin-coated carrier particle containing this resin layer is reduced, a difference in the chargeability depending on the environment is reduced, and degradation of a charge amount caused under a high-temperature and high-humidity environment in particular is inhibited. Besides, the resin has appropriate mechanical strength, and the surface of the resin layer is appropriately abraded. As a result, the surface of the carrier particle is refreshed.

The radical polymer has a weight average molecular weight Mw of, for example, 10,000 to 800,000, and more preferably 100,000 to 750,000. The weight average molecular weight Mw can be obtained by gel permeation chromatography (GPC). A content of a cycloalkyl group in the radical polymer is, for example, 10 to 90 mass %. The content of the cycloalkyl group in the resin can be obtained by any of known instrumental analysis methods such as P-GC/MS or $^1$H-NMR.

The alicyclic methacrylic acid ester is, for example, a methacrylic acid ester having a $C_{5-8}$ cycloalkyl group, and specific examples include cyclopentyl methacrylate, cyclohexyl methacrylate, cycloheptyl methacrylate and cyclooctyl methacrylate. Among these, cyclohexyl methacrylate is particularly preferred from the viewpoint of the mechanical strength and the environmental stability of the charge amount. It is noted that the monomer of the resin may further contain another monomer (such as another acrylic monomer) as long as the above-described effects of the resin can be obtained.

The thickness of the resin layer is preferably 0.05 to 4.0 μm, and more preferably 0.2 to 3.0 μm from the viewpoint of attaining both durability of the carrier particle and reduction of electrical resistance. If the thickness of the resin layer falls in the above-described range, both the chargeability and the durability of the carrier particle can be set to preferable ranges. The thickness of the resin layer can be obtained, for example, as an average of thicknesses of resin layers measured in an appropriate number of samples of the resin-coated carrier particle.

The carrier particle has saturation magnetization of preferably 30 to 75 Am$^2$/kg, and residual magnetization of preferably 5.0 Am$^2$/kg or less. The carrier particle having such magnetic characteristics is preferably used because the carrier particle can be inhibited from agglomerating, and can be easily evenly dispersed on a surface of a developer conveyance member (a developing roller) in development, and therefore, a uniform and highly-defined toner image free from density unevenness can be thus formed.

The toner can be produced by, for example, a production process including the following steps (1) to (3):

(1) A step of agglomerating and fusing at least a fine particle of a binder resin in an aqueous medium (first step);

(2) a step of obtaining a wet toner base particle by separating an agglomerated particle from the aqueous medium (second step); and (3) a step of drying the wet toner base particle by conveyance through airstream of 30 to 40° C. (third step).

The first step can be performed as known, for example, by agglomerating the fine particle in the aqueous medium adjusted to be alkaline and fusing the particle by heating the aqueous medium. The aqueous medium is a liquid containing water as a principal component (in, for example, 50 vol % or more), and optionally containing a water-soluble organic compound. For adjusting pH of the aqueous medium, any of known basic compounds such as sodium hydroxide can be used. The agglomeration reaction of the fine particle can be substantially stopped by increasing a salt concentration in the aqueous medium.

The fine particle of the binder resin may be a fine particle formed by uniformly integrating binder resin components, may be a combination of fine particles of the respective binder resin components, or may contain both. As the fine particle of the binder resin, for example, a fine particle containing the hybrid crystalline resin and the amorphous resin may be used, or a fine particle containing a fine particle of the hybrid crystalline resin and a fine particle of the amorphous resin may be used. An amount of the fine particle of the hybrid crystalline resin can be appropriately determined, together with amounts of the amorphous resin and other arbitrary materials, so as to attain a content of 3 to 30 mass % in the toner base particle.

Besides, in the first step, a material excluding the binder resin may be further contained in the fine particle of the binder resin, or a fine particle of a material excluding the binder resin may be further added to be agglomerated and fused.

The second step can be performed by a known solid-liquid separation method. The second step preferably further includes a step of washing the obtained wet toner base particle. Besides, the second step may further include, if necessary, a step of adjusting the particle size or shape of the toner base particle.

The third step can be performed by a known method in which the toner base particle is dried, during conveyance, with hot air at a desired temperature, and a known apparatus capable of such drying can be used. An example of the apparatus includes "Flash Jet Dryer" manufactured by Seishin Enterprise Co., Ltd.

The temperature of the airstream employed in the third step is preferably 30 to 40° C. If the temperature is 30° C. or lower, it takes time to dry the toner base particle to degrade productivity, and a degree of crystallinity described later becomes too high in some cases. If the temperature is 40° C. or higher, too much thermal energy is applied to the toner base particle, and hence the toner base particle is agglomerated and the flow ability of the toner base particle is degraded, and the degree of crystallinity may become too low in some cases. From the viewpoint of appropriately controlling the degree of crystallinity (fracture resistance), the temperature is more preferably 35 to 40° C.

The production process for the toner described above may further include another additional step in addition to the first to third steps as long as the effects of the present embodiment can be exhibited. Examples of the additional step include a step of obtaining a toner particle by mixing and attaching an external additive with and to the toner base particle, and a step of obtaining the toner as a two-component developer by mixing the obtained toner particle with a carrier particle.

The toner is applied to a general electrophotographic image forming method to be used for developing an electrostatic latent image. The toner is contained in an image forming apparatus, for example, as illustrated in FIG. 1, to be used for forming a toner image on a recording medium.

Image forming apparatus 1 illustrated in FIG. 1 includes image reading section 110, image processing section 30, image forming section 40, sheet conveying section 50 and fixing device 60.

Image forming section 40 includes image forming units 41Y, 41M, 41C and 41K respectively forming images of color toners of Y (yellow), M (magenta), C (cyan) and K (black). These image forming units have the same structure excluding the color of the toner contained therein, and hence are hereinafter sometimes referred to without using a sign corresponding to the color. Image forming section 40 further includes intermediate transfer unit 42 and secondary transfer unit 43. These units correspond to a transfer device.

Each image forming unit 41 includes exposing device 411, developing device 412, photoconductor drum 413, charging device 414 and drum cleaning device 415. Photoconductor drum 413 is, for example, a negative charge type organic photoconductor. The surface of photoconductor drum 413 is photoconductive. Photoconductor drum 413 corresponds to a photoconductor. Charging device 414 is, for example, a corona charger. Charging device 414 may be a contact charging device for charging photoconductor drum 413 by bringing a contact charging member, such as a charging roller, a charging brush or a charging blade, into contact with photoconductor drum 413. Exposing device 411 includes, for example, a semiconductor laser serving as a light source, and an optical deflecting device (polygon motor) irradiating photoconductor drum 413 with a laser beam in accordance with an image to be formed.

Figure 2:
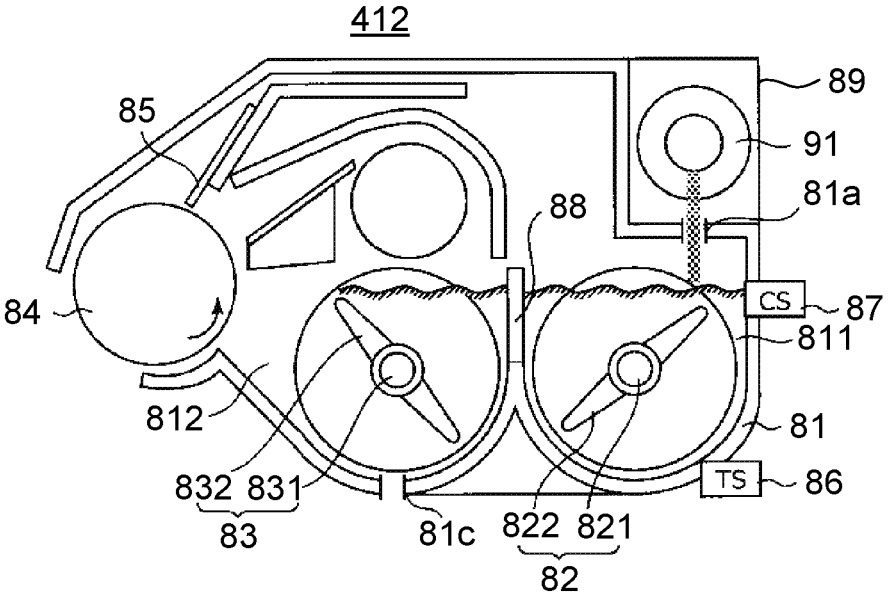
FIG. 2 is a schematic diagram illustrating an example of the structure of a developing device in which the toner according to the embodiment of the present invention is used.

Developing device 412 is a two-component development type developing device as illustrated in FIG. 2. Developing device 412 includes developer container 81, stirring screw 82, supply screw 83, developing roller 84, developer restriction member 85, toner density sensor 86, carrier detection sensor 87 and toner supply section 89.

Developer container 81 contains the two-component developer made of the toner particle and the carrier particle. Developer container 81 includes partition 88 that is disposed between stirring screw 82 and supply screw 83 for dividing the inside of developer container 81 into developer stirring path 811 and developer supply path 812 extending in parallel to the axial direction of developing roller 84. Developer outlet 81*c* is provided in a most downstream position, along a conveyance direction of the developer, in developer supply path 812. Stirring screw 82 includes shaft 821, and spiral blade 822 formed over substantially the whole length of the shaft at a prescribed pitch, and supply screw 83 includes, similarly to stirring screw 82, shaft 831, and spiral blade 832 formed over substantially the whole length of the shaft at a prescribed pitch.

Toner supply section 89 is disposed above developer container 81. Toner supply section 89 has toner supply port 81*a* capable of connecting/disconnecting toner supply section 89 and developer container 81 to/from each other, and a hopper not illustrated containing the toner and connected to toner supply port 81*a*. To toner supply section 89, toner bottle 91 that supplies the toner particle to the hopper is connected rotatably around the central axis thereof. Toner bottle 91 is connected to toner supply section 89 with the axial direction thereof set to be substantially horizontal.

Figure 3:
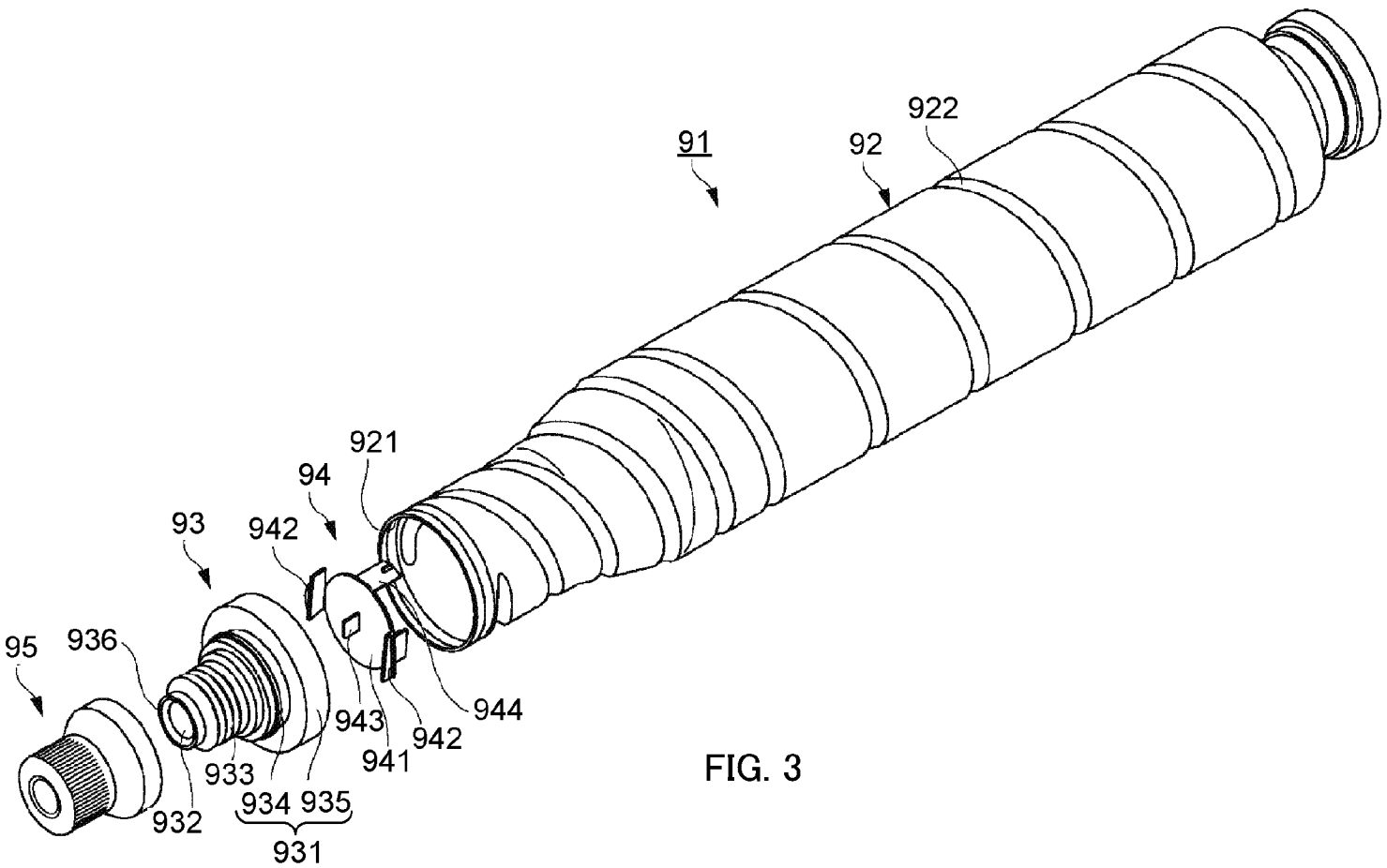
FIG. 3 is a schematic diagram illustrating an example of the structure of a toner bottle in which the toner according to the embodiment of the present invention is contained.

Toner bottle 91 is made of, for example, a resin, and includes, as illustrated in FIG. 3, container main body 92, discharge member 93 disposed in a tip portion of container main body 92, and restriction member 94 disposed inside container main body 92 and discharge member 93. Toner bottle 91 contains the above-described toner particle.

Container main body 92 is in a substantially cylindrical hollow shape, and has opening 921 on a tip side. On a sidewall of container main body 92, ridge portion 922 projecting inward from the sidewall is formed. Ridge portion 922 is formed spirally from a rear end portion to the tip portion of container main body 92. It is noted that the spiral direction of ridge portion 922 is set in accordance with the rotational direction of container main body 92.

Discharge member 93 is attached to container main body 92 to close opening 921. Discharge member 93 includes mouth portion 931, discharging portion 932 and covering portion 933.

Mouth portion 931 is in a cylindrical shape, and has thread portion 934 on a tip side and catch portion 935 on a rear side. Thread portion 934 is screwed into a thread groove provided in the inside of cap 95. Catch portion 935 catches the tip portion of container main body 92.

Discharging portion 932 has engaging portion 936. Engaging portion 936 holds covering portion 933 covering the circumference of discharging portion 932. Covering portion 933 is a substantially cylindrical stretchable bellow-like member, and has a base fixed on a tip of mouth portion 931 and a tip held by engaging portion 936. When toner bottle 91 is inserted into toner supply section 89 to be loaded, covering portion 933 contracts to cause a supply port not illustrated to appear, and toner bottle 91 is connected to toner supply section 89.

Restriction member 94 includes partition portion 941, and further includes, on a tip side of partition portion 941, a pair of engaging portions 942 projecting from edges of partition portion 941, and knob portion 943 projecting from a center part of partition portion 941, and on a rear side of partition portion 941, a pair of leg portions 944 projecting from edges of partition portion 941. Partition portion 941 is in a circular plate shape, and has a diameter smaller than the diameter of opening 921. The pair of engaging portions 942 are engaged with an end, closer to opening 921, of ridge portion 922 inside container main body 92, so that restriction member 94 can be disposed within container main body 92 in the vicinity of opening 921 of container main body 92.

Intermediate transfer unit 42 includes intermediate transfer belt 421, primary transfer roller 422 pressing intermediate transfer belt 421 against each photoconductor drum 413, a plurality of support rollers 423 including backup roller 423A, and belt cleaning device 426. Intermediate transfer belt 421 is extended, in a loop shape, among plural support rollers 423. When at least one drive roller out of plural support rollers 423 rotates, intermediate transfer belt 421 runs at a constant speed in a direction of arrow A.

Secondary transfer unit 43 includes endless secondary transfer belt 432, and a plurality of support rollers 431 including secondary transfer roller 431A. Secondary transfer belt 432 is extended, in a loop shape, among secondary transfer roller 431A and support rollers 431.

Fixing device 60 includes, for example, fixing roller 62, endless heating belt 63 covering an outer peripheral surface of fixing roller 62 and heating and melting a toner forming a toner image on sheet S, and pressure roller 64 pressing sheet S against fixing roller 62 and heating belt 63. Sheet S corresponds to a recording medium.

Image forming apparatus 1 further includes image reading section 110, image processing section 30 and sheet conveying section 50 as described above. Image reading section 110 includes sheet feeding device 111 and scanner 112. Sheet conveying section 50 includes sheet feed section 51, sheet ejection section 52 and conveyance path section 53. In three sheet feed tray units 51*a* to 51*c* included in sheet feed section 51, sheets S (including standard sheets and special sheets) identified based on weight or size are contained separately in accordance with types of sheets precedently set. Conveyance path section 53 includes a plurality of conveyance roller pairs such as registration roller pair 53*a*.

Image formation performed by image forming apparatus 1 will now be described.

Scanner 112 optically scans and reads original D placed on a contact glass. Reflected light from original D is read by CCD sensor 112*a* to obtain input image data. The input image data is subjected to prescribed image processing in image processing section 30, and the resultant is transferred to exposing device 411.

Each photoconductor drum 413 rotates at a constant peripheral speed. Charging device 414 evenly negatively charges the surface of photoconductor drum 413. In exposing device 411, a polygon mirror of the polygon motor rotates at a high speed, laser beams in accordance with respective color components of the input image data are developed along the axial direction of photoconductor drum 413, so as to irradiate the outer peripheral surface of photoconductor drum 413 along the axial direction. In this manner, an electrostatic image is formed on the surface of photoconductor drum 413.

In developing device 412, the toner particle is charged by stirring and conveying the two-component developer in the developer container, and the resultant two-component developer is conveyed to the developing roller, and forms a magnetic brush on the surface of the developing roller. The charged toner particle electrostatically adheres, from the magnetic brush, onto a portion of photoconductor drum 413 corresponding to the electrostatic latent image. In this manner, the electrostatic latent image on the surface of photoconductor drum 413 is visualized, and a toner image corresponding to the electrostatic latent image is formed on the surface of photoconductor drum 413.

The amount of the toner particle contained in developer container 81 is detected by toner density sensor 86. If the amount of the toner particle becomes small, toner bottle 91 is rotatively driven in accordance with a detection signal of toner density sensor 86. Thus, restriction member 94 is rotatively driven together with toner bottle 91, and the toner particle contained in toner bottle 91 is conveyed to discharging portion 932 through a gap between restriction member 94 and toner bottle 91, and contained in the hopper of toner supply section 89. When a necessary amount of the toner particle is contained in the hopper, the rotational drive of toner bottle 91 is stopped, and hence the supply of the toner particle to the hopper is stopped. Then, toner supply port 81*a* is opened, the toner particle contained in the hopper is supplied into developer container 81, and thus, the toner particle is replenished to developer container 81.

The toner particle has an appropriate average circularity of 0.945 or higher and lower than 0.965, and the external additive of the toner particle contains the silica particle having an average circularity of 0.5 or higher and 0.9 or lower and having a comparatively large particle size, and the fatty acid metal salt particle having a median diameter (D50s) of 0.50 μm or more and 2.00 μm or less. Accordingly, a distance among toner particles can be appropriately retained in the two-component developer, and sufficient flow ability of the toner particle can be kept for a long period of time. Therefore, no matter how long toner bottle 91 is stored or loaded, a desired amount of the toner particle is replenished from toner bottle 91 to developer container 81 for a long period of time.

Besides, since the toner particle has the appropriate average circularity and contains the external additive providing the stable flow ability, the toner particle exhibits sufficiently good developability and transferability.

Furthermore, since the toner particle contains the fatty acid metal salt particle described above as the external additive, the fatty acid metal salt can be caused to evenly exist on the photoconductor regardless of an image pattern to be formed. Therefore, the occurrence of filming (lubricant filming) or silica filming otherwise caused by a fatty acid metal salt present on the photoconductor can be inhibited. As a result, stable images can be formed over a long period of time.

The toner image formed on the surface of photoconductor drum 413 is transferred onto intermediate transfer belt 421 by intermediate transfer unit 42. A portion of the toner remaining on the surface of photoconductor drum 413 after the transfer is removed by drum cleaning device 415 having a drum cleaning blade brought into sliding contact with the surface of photoconductor drum 413.

Since intermediate transfer belt 421 is pressed against photoconductor drum 413 by primary transfer roller 422, a primary transfer nip is formed on each photoconductor drum by photoconductor drum 413 and intermediate transfer belt 421. In these primary transfer nips, toner images of the respective colors are successively transferred to be superimposed on intermediate transfer belt 421.

On the other hand, secondary transfer roller 431A is pressed against backup roller 423A via intermediate transfer belt 421 and secondary transfer belt 432. Therefore, a secondary transfer nip is formed by intermediate transfer belt 421 and secondary transfer belt 432. Sheet S is conveyed by sheet conveying section 50 to the secondary transfer nip, and passes through the secondary transfer nip. A registration roller section including registration roller pair 53*a* corrects inclination of sheet S and adjusts conveying timing of sheet S.

When sheet S is conveyed to the secondary transfer nip, a transfer bias is applied to secondary transfer roller 431A. Through the application of the transfer bias, the toner image born on intermediate transfer belt 421 is transferred onto sheet S. Sheet S having the toner image transferred thereon is conveyed toward fixing device 60 by secondary transfer belt 432.

Fixing device 60 forms a fixing nip between heating belt 63 and pressure roller 64, so as to heat and press conveyed sheet S in the fixing nip. The toner particle contained in the toner image born on sheet S is heated, and hence the hybrid crystalline resin is rapidly melted therein, and as a result, the whole toner particle rapidly melts with a comparatively small amount of heat. Therefore, the toner component adheres to sheet S, and is rapidly crystallized thereon and rapidly solidified. Thus, the toner image is rapidly fixed on sheet S with a comparatively small amount of heat. Sheet S having the toner image fixed thereon is ejected out of the apparatus by sheet ejection section 52 including sheet ejection roller 52*a*. In this manner, a high quality image is formed.

Incidentally, a portion of the toner remaining on the surface of intermediate transfer belt 421 after the secondary transfer is removed by belt cleaning device 426 having a belt cleaning blade brought into sliding contact with the surface of intermediate transfer belt 421.

As is obvious from the above description, the toner includes the toner particle containing the toner base particle and the external additive adhering to the surface of the toner base particle, and the toner base particle contains the crystalline polyester resin and the amorphous polyester resin. The average circularity of the toner particle is 0.945 or higher and lower than 0.965, and the external additive contains the silica particle and the fatty acid metal salt particle. The silica particle has a volume average particle size of 70 nm or more and 300 nm or less, the silica particle has an average circularity of 0.5 or higher and 0.9 or lower, and the fatty acid metal salt particle has a median diameter based on the volume of 0.50 μm or more and 2.00 μm or less. Accordingly, in the electrophotographic image forming method, the toner has sufficient low-temperature fixability and bottle dischargeability, and can form high quality images for a long period of time.

Besides, it is more effective, from the viewpoint of inhibiting the silica filming, if the fatty acid metal salt of the fatty acid metal salt particle is zinc stearate.

If the silica particle has a porous structure, desired particle shape and particle size of the silica particle can be advantageously realized.

It is more effective, from the viewpoint of retaining stable flow ability of the toner particle in the toner bottle, if the silica particle is hydrophobized with an alkylalkoxysilane compound represented by the following formula. In the following formula, $R_1$ represents an optionally substituted straight chain $C_{4-16}$ alkyl group, and $R_2$ independently represents a methyl group or an ethyl group.

$$R_1—Si(OR_2)_3$$

Besides, it is more effective, from the viewpoint of improving the transferability, if the silica particle has been hydrophobized with hexamethyldisilazane.

Moreover, it is more effective, from the viewpoint of inhibiting the silica filming and the lubricant filming, if the contents of the silica particle and the fatty acid metal salt particle satisfy the following formula. In the following formula, X represents a content (in parts by mass) of the fatty acid metal salt particle relative to 100 parts by mass of the toner base particle, and Y represents a content (in parts by mass) of the silica particle relative to 100 parts by mass of the toner base particle.

$$0.025 \leq X/Y \leq 0.075$$

It is more effective, from the viewpoint of retaining the stable flow ability of the toner particle in the toner bottle, if the amorphous polyester resin is a hybrid amorphous polyester resin formed by chemical binding of a polyester polymerized segment and another polymerized segment, and if the crystalline polyester resin is a hybrid crystalline polyester resin formed by chemical bonding of a polyester polymerized segment and another polymerized segment. In addition, it is further more effective from the above-described viewpoint if the another polymerized segment is a vinyl-based polymerized segment.

In this manner, according to the present embodiment, a toner having sufficient low-temperature fixability and bottle dischargeability and capable of forming high quality images for a long period of time can be provided.

EXAMPLES

The present invention will now be more specifically described with reference to examples and comparative examples. It is noted that the present invention is not limited to the following examples and the like. In the following examples, the terms "part(s)" and "%" respectively mean "part(s) by mass" and "mass %" unless otherwise specified.

(1) Preparation of Colorant Fine Particle Dispersion

Eleven point five (11.5) parts by mass of sodium n-dodecyl sulfate was added to 160 parts by mass of ion-exchanged water, and 24.5 parts by mass of copper phthalocyanine was slowly added to the resultant solution under stirring. The thus obtained solution was subjected to a dispersion treatment using a stirrer "Clearmix W motion CLM-0.8" (manufactured by M Technique Co., Ltd., "Clearmix" being their registered trademark) to prepare a dispersion of a colorant fine particle (colorant fine particle dispersion) having a median diameter based on the volume of 126 nm.

(2) Preparation of Release Agent Dispersion

Fifty (50) parts by mass of paraffin wax (melting point: 73° C.), 2 parts by mass of sodium n-dodecyl sulfate and 200 parts by mass of ion-exchanged water were mixed, and the thus obtained mixture was heated to 120° C. The mixture was mixed and dispersed using Ultra Turrax T50 manufactured by IKA, the resultant was subjected to a dispersion treatment at 80° C. using a pressure discharge homogenizer, and thus, a release agent dispersion in which a volume average particle size of the paraffin wax particle was 200 nm and a content of the paraffin wax particle (solid component) was 20 mass % was obtained.

(3) Preparation of Dispersion of Amorphous Polyester Resin Fine Particle (3-1) Synthesis of Amorphous Polyester Resin A reaction tank equipped with a condenser, a stirrer and a nitrogen introducing tube was charged with 360 parts by mass of bisphenol A propylene oxide 2-mol adduct, 80 parts by mass of terephthalic acid and 55 parts by mass of fumaric acid, and subsequently, 2 parts by mass of titanium tetraisopropoxide was added, as a polycondensation catalyst, to the obtained reaction layer dividedly in ten aliquots, and the resultant was reacted at 200° C. for 10 hours under a nitrogen stream while distilling off generated water. Subsequently, the resultant was reacted under reduced pressure of 13.3 kPa (100 mmHg), and a reaction product was taken out when a softening point reached 104° C. Thus, an amorphous polyester resin was synthesized.

(3-2) Preparation of Amorphous Polyester Resin Particle Dispersion

One hundred (100) parts by mass of the thus obtained amorphous polyester resin was ground using "Roundel Mill Model: RM" (manufactured by Tokuju Corporation), and was mixed with 638 parts by mass of a precedently prepared 0.26 mass % sodium lauryl sulfate solution. The resultant was subjected, under stirring, to the ultrasonic dispersion using an ultrasonic homogenizer "US-150T" (manufactured by Nihonseiki Kaisha Ltd.) at V-Level and 300 μA for 30 minutes, and thus, a dispersion of the amorphous polyester resin fine particle (amorphous polyester dispersion) in which the resin particle had a median diameter (D50) based on the volume of 250 nm was prepared.

(4) Preparation of Dispersion of Crystalline Polyester Resin Fine Particle (4-1) Synthesis of Crystalline Polyester Resin A reaction tank equipped with a condenser, a stirrer and a nitrogen introducing tube is charged with 118 parts by mass of 1,6-hexanediol and 271 parts by mass of tetradecanedioic acid, and subsequently, 0.8 parts by mass of titanium tetraisopropoxide was added, as a polycondensation catalyst, to the obtained reaction layer dividedly in ten aliquots, and the resultant was reacted at 235° C. for 5 hours under a nitrogen stream while distilling off generated water. Subsequently, the resultant was reacted for 1 hour under reduced pressure of 13.3 kPa (100 mmHg), and thus, a crystalline polyester resin was synthesized.

(4-2) Preparation of Crystalline Polyester Resin Particle Dispersion

One hundred (100) parts by mass of the thus obtained crystalline polyester resin was ground using "Roundel Mill Model: RM" (manufactured by Tokuju Corporation), and was mixed with 638 parts by mass of a precedently prepared 0.26 mass % sodium lauryl sulfate solution. The resultant was subjected, under stirring, to the ultrasonic dispersion using an ultrasonic homogenizer "US-150T" (manufactured by Nihonseiki Kaisha Ltd.) at V-Level and 300 μA for 30 minutes, and thus, a dispersion of the crystalline polyester resin fine particle (crystalline polyester dispersion) in which the resin particle had a median diameter (D50) based on the volume of 200 nm was prepared.

(5) Preparation of Dispersion of Vinyl-modified Amorphous Polyester Resin Fine Particle (5-1) Synthesis of Vinyl-modified Amorphous Polyester Resin A 10-liter four-necked flask equipped with a nitrogen introducing tube, a dehydration tube, a stirrer and a thermocouple was charged with materials A listed below, and the resultant was condensation-polymerized at 230° C. for 8 hours, further reacted at 8 kPa for 1 hour, and then cooled to 160° C. Subsequently, a mixture of materials B listed below was added through a dropping funnel in a dropwise manner into the four-necked flask over 1 hour, and after the dropwise addition, the resultant was continuously addition-polymerized for 1 hour with the temperature kept at 160° C. Thereafter, a product obtained in the four-necked flask was heated to 200° C., and kept at 200° C. and 10 kPa for 1 hour so as to remove acrylic acid, styrene and butyl acrylate, and thus, a vinyl-modified amorphous polyester resin was obtained.

(Material A)

| | |
|---|---|
| Bisphenol A propylene oxide 2-mol adduct | 480 parts by mass |
| Terephthalic acid | 130 parts by mass |
| Fumaric acid | 85 parts by mass |
| Esterification catalyst (tin octanoate) | 2 parts by mass |

(Material B)

| | |
|---|---|
| Acrylic acid | 8.6 parts by mass |
| Styrene | 131 parts by mass |
| Butyl acrylate | 30 parts by mass |
| Polymerization initiator (di-t-butyl peroxide) | 10 parts by mass |

(5-2) Preparation of Vinyl-modified Amorphous Polyester Resin Particle Dispersion One hundred (100) parts by mass of the thus obtained vinyl-modified polyester resin was ground using "Roundel Mill Model: RM" (manufactured by Tokuju Corporation), and was mixed with 638 parts by mass of a precedently prepared 0.26 mass % sodium lauryl sulfate solution. The resultant was subjected, under stirring, to the ultrasonic dispersion using an ultrasonic homogenizer "US-150T" (manufactured by Nihonseiki Kaisha Ltd.) at V-Level and 300 μA for 30 minutes, and thus, a vinyl-modified amorphous polyester resin fine particle dispersion (vinyl-modified amorphous polyester dispersion) in which the resin particle had a median diameter (D50) based on the volume of 170 nm was prepared.

(6) Preparation of Dispersion of Vinyl-Modified Crystalline Polyester Resin Fine Particle (6-1) Synthesis of Vinyl-modified Crystalline Polyester Resin A 10-liter four-necked flask equipped with a nitrogen introducing tube, a dehydration tube, a stirrer and a thermocouple was charged with materials A listed below, and the resultant was condensation-polymerized at 230° C. for 8 hours, further reacted at 8 kPa for 1 hour, and then cooled to 160° C. Subsequently, a mixture of materials B listed below was added through a dropping funnel in a dropwise manner into the four-necked flask over 1 hour, and after the dropwise addition, the resultant was continuously addition-polymerized for 1 hour with the temperature kept at 160° C. Thereafter, a product obtained in the four-necked flask was heated to 200° C., and kept at 200° C. and 10 kPa for 1 hour so as to remove acrylic acid, styrene and butyl acrylate, and thus, a vinyl-modified crystalline polyester resin was obtained.

(Material A)

| | |
|---|---|
| Tetradecanedioic acid | 271 parts by mass |
| 1,6-Hexanediol | 118 parts by mass |
| Titanium tetraisopropoxide | 0.8 parts by mass |

(Material B)

| | |
|---|---|
| Acrylic acid | 8.6 parts by mass |
| Styrene | 131 parts by mass |
| Butyl acrylate | 30 parts by mass |
| Polymerization initiator (di-t-butyl peroxide) | 10 parts by mass |

(6-2) Preparation of Vinyl-modified Crystalline Polyester Resin Particle Dispersion One hundred (100) parts by mass of the thus obtained vinyl-modified crystalline polyester resin was ground using "Roundel Mill Model: RM" (manufactured by Tokuju Corporation), and was mixed with 638 parts by mass of a precedently prepared 0.26 mass % sodium lauryl sulfate solution. The resultant was subjected, under stirring, to the ultrasonic dispersion using an ultrasonic homogenizer "US-150T" (manufactured by Nihonseiki Kaisha Ltd.) at V-Level and 300 μA for 30 minutes, and thus, a vinyl-modified crystalline polyester resin fine particle dispersion (vinyl-modified crystalline polyester dispersion) in which the resin particle had a median diameter (D50) based on the volume of 170 nm was prepared.

<Production of Toner Base Particle 1>

A reaction vessel equipped with a stirrer, a temperature sensor and a condenser is charged with 250 parts by mass, in terms of a solid content, of the amorphous polyester dispersion, 50 parts by mass, in terms of a solid content, of the crystalline polyester dispersion, 25 parts by mass, in terms of a solid content, of the release agent dispersion, and 2,000 parts by mass of ion-exchanged water, and then, a 5 mol/L sodium hydroxide aqueous solution was added thereto to adjust pH of the thus obtained mixture to 10. Thereafter, 40 parts by mass, in terms of a solid content, of the colorant fine particle dispersion was added to the resultant mixture.

Subsequently, an aqueous solution obtained by dissolving 60 parts by mass of magnesium chloride in 60 parts by mass of ion-exchanged water was added, under stirring, to the mixture at 30° C. over 10 minutes. The resultant mixture was allowed to stand still for 3 minutes, and thereafter, heating was started to heat the mixture to 80° C. over 60 minutes, and the temperature was kept at 80° C. for continuing a particle growth reaction. Under this condition, the particle size of a combined particle was measured with "Multisizer 3" (manufactured by Beckman Coulter Ind.), and when a median diameter (D50) based on the volume of 6.5 μm was attained, an aqueous solution obtained by dissolving 190 parts by mass of sodium chloride in 760 parts by mass of ion-exchanged water was added to the mixture to stop the growth of the particle.

The mixture was further heated, and at a temperature of 90° C., the mixture was heated under stirring to fuse the particle. When an average circularity of the particle contained in the mixture measured using a measurement apparatus for an average circularity of a toner, "FPIA-2100" (manufactured by Sysmex Corporation) (with HPF detection number set to 4,000) became 0.955, the mixture was cooled to 30° C.

The mixture containing the particle is subjected to the solid-liquid separation using a centrifuge to form a wet cake of the particle. The wet cake was washed with ion-exchanged water at 35° C. using the centrifuge until a filtrate attained electric conductivity of 5 μS/cm, and then, the resultant was transferred to "Flash Jet Dryer" (manufactured by Seishin Enterprise Co., Ltd.) and dried until a water content became 0.5 mass %. Thus, toner base particle 1 was produced.

<Production of Toner Base Particle 2>

Toner base particle 2 was produced in the same manner as in the production of toner base particle 1 except that the amorphous polyester dispersion was replaced with the vinyl-modified amorphous polyester dispersion.

<Production of Toner Base Particle 3>

Toner base particle 3 was produced in the same manner as in the production of toner base particle 1 except that the crystalline polyester dispersion was replaced with the vinyl-modified crystalline polyester dispersion.

<Production of Toner Base Particle 4>

Toner base particle 4 was produced in the same manner as in the production of toner base particle 1 except that the amorphous polyester dispersion was replaced with the vinyl-modified amorphous polyester dispersion, and that the crystalline polyester dispersion was replaced with the vinyl-modified crystalline polyester dispersion.

<Production of Toner Base Particles 5 to 8>

Toner base particle 5 having an average circularity of 0.945, toner base particle 6 having an average circularity of 0.964, toner base particle 7 having an average circularity of 0.944 and toner base particle 8 having an average circularity of 0.965 were produced in the same manner as in the production of toner base particle 4 except that the time for fusing the particle was properly adjusted.

The types and the average circularities of the binder resins respectively used in toner base particles 1 to 8 are shown in Table 1. In Table 1, "C-Pes" stands for "crystalline polyester", "A-Pes" stands for "amorphous polyester", "VMCP" stands for "vinyl-modified crystalline polyester", and "VMAP" stands for "vinyl-modified amorphous polyester".

TABLE 1

| Toner Base Particle No. | Type Of Binder Resin | | Average Circularity (—) |
|---|---|---|---|
| 1 | C-Pes | A-Pes | 0.955 |
| 2 | C-Pes | VMAP | 0.955 |

TABLE 1-continued

| Toner Base Particle No. | Type Of Binder Resin | | Average Circularity (—) |
|---|---|---|---|
| 3 | VMCP | A-Pes | 0.955 |
| 4 | VMCP | VMAP | 0.955 |
| 5 | VMCP | VMAP | 0.945 |
| 6 | VMCP | VMAP | 0.964 |
| 7 | VMCP | VMAP | 0.944 |
| 8 | VMCP | VMAP | 0.965 |

<Production of Silica Particle 1>

Into an Erlenmeyer flask, 347.4 g of pure water was weighed, 102.6 g of tetramethoxysilane was added thereto under stirring, and the resultant was stirred for 1 hour to produce 450 g of a hydrolyzed tetramethyl orthosilicate (TMOS) solution.

Next, a 3-L glass reactor equipped with a stirrer, a dropping funnel and a thermometer was charged with 2,250 g of water and 36 g (charged-in amount) of ethylenediamine for mixing these. The temperature of the resultant solution was adjusted to 35° C., and the hydrolyzed TMOS solution was added thereto under stirring at 2.5 mL/min.

The thus obtained mixture was kept at 35° C. for 30 minutes, and 4.5 g of a 1 mmol/g ethylenediamine aqueous solution was added to the mixture to adjust pH of the mixture to 8 to 9.

Thereafter, with the alkaline catalyst (ethylenediamine) appropriately added to keep the mixture at pH 8, the hydrolyzed TMOS solution was added thereto at a prescribed rate every 3 hours.

After completing the dropwise addition, the resultant was continuously stirred for 0.5 hours to perform hydrolysis and condensation, and thus, a mixed medium dispersion of a hydrophilic spherical silica fine particle (spherical silica dispersion A) was obtained.

To spherical silica dispersion A, 4 g of methyltrimethoxysilane was added in a dropwise manner at room temperature over 0.5 hours, and then, the resultant was reacted for 1 hour by heating to 50° C. Thus, the surface of the silica fine particle was hydrophobized to obtain a mixed medium dispersion of a hydrophobic spherical silica fine particle (spherical silica dispersion B).

Subsequently, an ester adapter and a condenser were attached to the glass reactor, and spherical silica dispersion B was heated to 100° C. to distill off water. Thereafter, while adding 0.65 g of methyl isobutyl ketone, a mixture of methanol, water and methyl isobutyl ketone was simultaneously distilled off until the temperature of the dispersion reached 115° C. After adding 82.5 g of octyltrimethoxysilane (OTMS) to the thus obtained methyl isobutyl ketone dispersion at room temperature, the resultant dispersion was heated to 110° C. to react octyltrimethoxysilane for 3 hours for alkylating the spherical silica fine particle contained in the dispersion (for causing an octyl group to bind to the surface of the spherical silica fine particle). Subsequently, the solvent of the thus obtained dispersion was distilled off at 80° C. under reduced pressure (6.650 Pa) to obtain 155 g of a hydrophobic spherical silica fine particle. This particle is defined as silica particle 1.

A volume average particle size D50v of silica particle 1 obtained based on the observation and image analysis using an SEM as described above was 110 nm. An average circularity of silica particle 1 obtained based on the observation and image analysis using an SEM as described above was 0.75.

<Production of Silica Particles 2 to 5>

Silica particles 2 to 5 were obtained in the same manner as in the production of silica particle 1 except that the type of the surface treating agent was changed. Specifically, octyltrimethoxysilane was replaced with isobutyltrimethoxysilane (IBTMS) to obtain silica particle 2, with hexadecane trimethoxysilane (HDTMS) to obtain silica particle 3, with dimethyl silicone (DMS, "SH200-10,000CS" manufactured by Dow Corning Toray Co., Ltd.) to obtain silica particle 4, and with hexamethyldisilazane (HMDS) to obtain silica particle 5.

<Production of Silica Particles 6 to 9>

Silica particles 6 to 9 were obtained in the same manner as in the production of silica particle 5 except that the charged-in amount of ethylenediamine was changed. Specifically, the charged-in amount of ethylenediamine was set to 42 g to obtain silica particle 6, to 20 g to obtain silica particle 7, to 45 g to obtain silica particle 8, and to 18 g to obtain silica particle 9.

<Production of Silica Particles 10 to 13>

Silica particles 10 to 13 were obtained in the same manner as in the production of silica particle 5 except that the addition rate of the hydrolyzed TMOS solution was changed. Specifically, the addition rate of the hydrolyzed TMOS solution was set to 4.5 mL/min to obtain silica particle 10, to 1.5 mL/min to obtain silica particle 11, to 5.0 mL/min to obtain silica particle 12, and to 1.0 mL/min to obtain silica particle 13.

The charged-in amount $C_{EDA}$ of ethylenediamine, the addition rate $V_{TMOS}$ of the hydrolyzed TMOS solution and the type of the surface treating agent employed in the production of each of silica particles 1 to 13, and the volume average particle sizes D50v and the average circularities AC of silica particles 1 to 13 are shown in Table 2.

TABLE 2

| Silica Particle No. | $C_{EDA}$ (g) | $V_{TMOS}$ (ml/min) | Surface Treating Agent | D50v (nm) | AC (—) |
|---|---|---|---|---|---|
| 1 | 36 | 2.5 | OTMS | 110 | 0.75 |
| 2 | 36 | 2.5 | IBTMS | 110 | 0.75 |
| 3 | 36 | 2.5 | HDTMS | 110 | 0.75 |
| 4 | 36 | 2.5 | DMS | 110 | 0.75 |
| 5 | 36 | 2.5 | HMDS | 110 | 0.75 |
| 6 | 42 | 2.5 | HMDS | 70 | 0.75 |
| 7 | 20 | 2.5 | HMDS | 300 | 0.75 |
| 8 | 45 | 2.5 | HMDS | 68 | 0.75 |
| 9 | 18 | 2.5 | HMDS | 310 | 0.75 |
| 10 | 36 | 4.5 | HMDS | 110 | 0.50 |
| 11 | 36 | 1.5 | HMDS | 110 | 0.90 |
| 12 | 36 | 5.0 | HMDS | 110 | 0.48 |
| 13 | 36 | 1.0 | HMDS | 110 | 0.92 |

<Production of Fatty Acid Metal Salt Particle 1>

A receiving vessel equipped with a stirrer was prepared, and the stirrer was rotated at 350 rpm. The receiving vessel was charged with 500 parts by mass of a 1.0 mass % sodium stearate aqueous solution, and the temperature of the solution was adjusted to 85° C. Next, to the receiving vessel, 525 parts by mass of a 0.4 mass % zinc sulfate aqueous solution was added in a dropwise manner over 15 minutes. After the dropwise addition, the resultant was stirred for 10 minutes at that temperature to age a reaction product, and then the reaction was completed to obtain a fatty acid metal salt slurry.

The obtained fatty acid metal salt slurry was washed by filtering, and the resultant fatty acid metal salt cake was coarsely crushed, and dried at 105° C. using a continuous flash dryer. The thus obtained dried product was ground, to reslurry, at an air flow of 6.0 $m^3$/min and a processing rate of 80 kg/hour using a nano grinding mill "NJ-300" (manufactured by Sunrex Kogyo Co., Ltd.), and the resultant was dried at 80° C. using the continuous flash drier to obtain fatty acid metal salt particle 1. The median diameter (D50s) based on the volume of obtained fatty acid metal salt particle 1 measured using the laser diffraction/scattering particle size distribution analyzer "LA-920" (manufactured by Horiba, Ltd.) was 1.10 μm.

<Production of Fatty Acid Metal Salt Particle 2>

Fatty acid metal salt particle 2 was produced in the same manner as in the production of fatty acid metal salt particle 1 except that the zinc sulfate aqueous solution was replaced with a lithium chloride aqueous solution.

<Production of Fatty Acid Metal Salt Particle 3>

Fatty acid metal salt particle 3 was produced in the same manner as in the production of fatty acid metal salt particle 1 except that the zinc sulfate aqueous solution was replaced with a magnesium sulfate aqueous solution.

<Production of Fatty Acid Metal Salt Particles 4 and 5>

Fatty acid metal salt particle 4 was produced in the same manner as in the production of fatty acid metal salt particle 1 except that the concentration of the sodium stearate aqueous solution was changed to 0.5 mass % and that the concentration of the zinc sulfate aqueous solution was changed to 0.2 mass %. Fatty acid metal salt particle 5 was produced in the same manner as in the production of fatty acid metal salt particle 1 except that the concentration of the sodium stearate aqueous solution was changed to 1.8 mass % and that the concentration of the zinc sulfate aqueous solution was changed to 0.9 mass %.

<Production of Fatty Acid Metal Salt Particles 6 and 7>

Fatty acid metal salt particle 6 was produced in the same manner as in the production of fatty acid metal salt particle 4 except that the air flow employed in grinding the fatty acid metal salt cake was changed to 8.5 $m^3$/min. Fatty acid metal salt particle 7 was produced in the same manner as in the production of fatty acid metal salt particle 5 except that the air flow employed in grinding the fatty acid metal salt cake was changed to 4.3 $m^3$/min.

The concentration $C_{SS}$ of the sodium fatty acid (stearate) aqueous solution, the concentration $C_{MS}$ of the metal salt aqueous solution and the air flow in grinding employed in the production of each of the fatty acid metal salt particles, and the median diameters D50s of the fatty acid metal salt particles and the types of the fatty acid metal salts are shown in Table 3. In Table 3, "Zn-Ste" stands for "zinc stearate", "Li-Ste" stands for "lithium stearate", and "Mg-Ste" stands for "magnesium stearate".

TABLE 3

| Fatty Acid Metal Salt Particle No. | $C_{SS}$ (mass %) | $C_{MS}$ (mass %) | Air Flow ($m^3$/min) | D50s (μm) | Fatty Acid Metal Salt |
|---|---|---|---|---|---|
| 1 | 1.0 | 0.4 | 6.0 | 1.10 | Zn-Ste |
| 2 | 1.0 | 0.4 | 6.0 | 1.05 | Li-Ste |
| 3 | 1.0 | 0.4 | 6.0 | 1.08 | Mg-Ste |
| 4 | 0.5 | 0.2 | 6.0 | 0.50 | Zn-Ste |
| 5 | 1.8 | 0.9 | 6.0 | 2.00 | Zn-Ste |
| 6 | 0.5 | 0.2 | 8.5 | 0.46 | Zn-Ste |
| 7 | 1.8 | 0.9 | 4.3 | 2.15 | Zn-Ste |

<Production of Toner 1>

One hundred (100) parts by mass of the toner base particle and materials listed below were added into a Henschel mixer, Model "FM20C/I" (manufactured by Nippon Coke & Engineering Co., Ltd.), and were stirred for 15 minutes with the rotating rate set to a blade-tip peripheral speed of 40 m/sec. A temperature of this powder mixture in stirring was set to 40° C.±1° C. If the temperature increased to 41° C., cooling water was supplied to a jacket of the Henschel mixer at a flow rate of 5 L/min, if the temperature lowered to 39° C., the cooling water was supplied at a flow rate of 1 L/min, and thus, the temperature within the Henschel mixer was controlled. In this manner, toner 1 was obtained.

| | |
|---|---|
| Silica particle 1 | 3 parts by mass |
| Fatty acid metal salt particle 1 | 0.15 parts by mass |
| Hydrophobic silica | 0.5 mass % |
| Hydrophobic titanium oxide | 0.4 mass % |

Incidentally, "hydrophobic silica" refers to a silica particle having been treated with hexamethyldisilazane (HMDS), and has hydrophobicity of 72% and a number average primary particle size of 30 nm. Besides, "hydrophobic titanium oxide" refers to a titanium oxide particle having been treated with HMDS, and has hydrophobicity of 55% and a number average primary particle size of 20 nm. The above-described addition amounts of the hydrophobic silica and the hydrophobic titanium oxide are in mass % based on the total amount of the toner.

<Production of Toners 2 to 5>

Toners 2 to 5 were obtained in the same manner as in the production of toner 1 except that silica particle 1 was replaced respectively with silica particles 2 to 5.

<Production of Toners 6 to 8>

Toner 6 was obtained in the same manner as in the production of toner 5 except that the addition amount of fatty acid metal salt particle 1 was changed to 0.075 parts by mass. Toner 7 was obtained in the same manner as in the production of toner 5 except that the addition amount of fatty acid metal salt particle 1 was changed to 0.225 parts by mass. Toner 8 was obtained in the same manner as in the production of toner 6 except that the addition amount of silica particle 5 was changed to 1.0 part by mass.

<Production of Toners 9 to 11>

Toner 9 was obtained in the same manner as in the production of toner 5 except that the addition amount of silica particle 5 was changed to 0.4 parts by mass and that the addition amount of fatty acid metal salt particle 1 was changed to 0.3 parts by mass. Toner 10 was obtained in the same manner as in the production of toner 5 except that the addition amount of silica particle 5 was changed to 0.5 parts by mass and that the addition amount of fatty acid metal salt particle 1 was changed to 0.4 parts by mass. Toner 11 was obtained in the same manner as in the production of toner 5 except that the addition amount of silica particle 5 was changed to 3.5 parts by mass and that the addition amount of fatty acid metal salt particle 1 was changed to 0.075 parts by mass.

<Production of Toners 12 to 15>

Toners 12 to 15 were obtained in the same manner as in the production of toner 1 except that fatty acid metal salt particle 1 was replaced respectively with fatty acid metal salt particles 2 to 5.

<Production of Toners 16 to 19>

Toners 16 to 19 were obtained in the same manner as in the production of toner 1 except that silica particle 1 was replaced respectively with silica particles 6, 7, 10 and 11.

<Production of Toners 20 to 26>

Toners 20 to 26 were obtained in the same manner as in the production of toner 1 except that toner base particle 4 was replaced respectively with toner base particles 1 to 3 and 5 to 8.

<Production of Toners 27 to 30>

Toners 27 to 30 were obtained in the same manner as in the production of toner 1 except that silica particle 1 was replaced respectively with silica particles 8, 9, 12 and 13.

<Production of Toners 31 and 32>

Toners 31 and 32 were obtained in the same manner as in the production of toner 1 except that fatty acid metal salt particle 1 was replaced respectively with fatty acid metal salt particles 6 and 7.

The type of the toner base particle, the type of the silica particle and the addition amount Y thereof, the type of the fatty acid metal salt particle and the addition amount X thereof, and a ratio X/Y between the content of the silica particle and the content of the fatty acid metal salt particle in each of toners 1 to 32 are shown in Table 4.

TABLE 4

| | | Silica Particle | | Fatty Acid Metal Salt Particle | | |
|---|---|---|---|---|---|---|
| Toner No. | Toner Base Particle No. | No. | Addition Amount Y (Parts By Mass) | No. | Addition Amount X (Parts By Mass) | X/Y (—) |
| 1 | 4 | 1 | 3 | 1 | 0.15 | 0.050 |
| 2 | 4 | 2 | 3 | 1 | 0.15 | 0.050 |
| 3 | 4 | 3 | 3 | 1 | 0.15 | 0.050 |
| 4 | 4 | 4 | 3 | 1 | 0.15 | 0.050 |
| 5 | 4 | 5 | 3 | 1 | 0.15 | 0.050 |
| 6 | 4 | 5 | 3 | 1 | 0.075 | 0.025 |
| 7 | 4 | 5 | 3 | 1 | 0.225 | 0.075 |
| 8 | 4 | 5 | 1 | 1 | 0.075 | 0.075 |
| 9 | 4 | 5 | 0.4 | 1 | 0.30 | 0.750 |
| 10 | 4 | 5 | 0.5 | 1 | 0.40 | 0.800 |
| 11 | 4 | 5 | 3.5 | 1 | 0.075 | 0.021 |
| 12 | 4 | 5 | 3 | 2 | 0.15 | 0.050 |
| 13 | 4 | 5 | 3 | 3 | 0.15 | 0.050 |
| 14 | 4 | 5 | 3 | 4 | 0.15 | 0.050 |
| 15 | 4 | 5 | 3 | 5 | 0.15 | 0.050 |
| 16 | 4 | 6 | 3 | 1 | 0.15 | 0.050 |
| 17 | 4 | 7 | 3 | 1 | 0.15 | 0.050 |
| 18 | 4 | 10 | 3 | 1 | 0.15 | 0.050 |
| 19 | 4 | 11 | 3 | 1 | 0.15 | 0.050 |
| 20 | 1 | 5 | 3 | 1 | 0.15 | 0.050 |
| 21 | 2 | 5 | 3 | 1 | 0.15 | 0.050 |
| 22 | 3 | 5 | 3 | 1 | 0.15 | 0.050 |
| 23 | 5 | 5 | 3 | 1 | 0.15 | 0.050 |
| 24 | 6 | 5 | 3 | 1 | 0.15 | 0.050 |
| 25 | 7 | 5 | 3 | 1 | 0.15 | 0.050 |
| 26 | 8 | 5 | 3 | 1 | 0.15 | 0.050 |
| 27 | 4 | 8 | 3 | 1 | 0.15 | 0.050 |
| 28 | 4 | 9 | 3 | 1 | 0.15 | 0.050 |
| 29 | 4 | 12 | 3 | 1 | 0.15 | 0.050 |
| 30 | 4 | 13 | 3 | 1 | 0.15 | 0.050 |
| 31 | 4 | 5 | 3 | 6 | 0.15 | 0.050 |
| 32 | 4 | 5 | 3 | 7 | 0.15 | 0.050 |

<Production of Carrier Core Particle>

Organic oxide particles were weighed to obtain a mixture of 35 mol % of MnO, 14.5 mol % of MgO, 50 mol % of $Fe_2O_3$ and 0.5 mol % of SrO, the mixture was mixed with water, and the resultant was ground with a wet media mill for 5 hours to obtain a slurry. The thus obtained slurry was dried with a spray dryer to obtain a true spherical particle.

After adjusting the particle size of the thus obtained particle, the particle was heated at 950° C. for 2 hours as pre-burning of the particle. Subsequently, the pre-burnt particle was ground for 1 hour with a wet ball mill using a stainless steel bead having a diameter of 0.3 cm, and was further ground for 2 hours using a zirconia bead having a diameter of 0.5 cm. As a binder, polyvinyl alcohol (PVA) was added to the pre-burnt particle in a ratio of 0.4 mass % based on a solid content, and the resultant was granulated and dried with a spray dryer. The thus obtained particle was kept in an electric furnace at a temperature of 1,250° C. for 5 hours as final burning of the particle.

Thereafter, the resultant burnt particle was coarsely crushed and further classified to adjust the particle size, and the resultant was subjected to magnetic separation for removing one having a low magnetic force. In this manner, a carrier core particle was obtained. The obtained carrier core particle had a volume average particle size of 32 μm.

<Production of Core Coating Resin>

Into an aqueous solution of 0.3 mass % sodium benzenesulfonate, cyclohexyl methacrylate and methyl methacrylate were added in a "mass ratio of 50:50" (copolymerization ratio), and potassium persulfate was further added thereto in an amount corresponding to 0.5 mass % of a total amount of the cyclohexyl methacrylate and methyl methacrylate for performing emulsion polymerization. The thus obtained resin was dried with a spray dryer to produce a resin for coating the core. A weight average molecular weight of this core coating resin obtained by the following method was 500,000.

(Measurement of Weight Average Molecular Weight (Mw))

For measuring the weight average molecular weight (Mw) (in terms of polystyrene) of the core coating resin, "HLC-8820" (manufactured by Tosoh Corporation) is used as a GPC apparatus, and "TSKguardcolumn and TSKgel Super HZM-M3 series" (manufactured by Tosoh Corporation) are used as columns. The temperature of the columns is kept at 40° C., and tetrahydrofuran (THF) is caused to flow as a carrier solvent at a flow rate of 0.2 mL/min.

The core coating resin is dissolved in tetrahydrofuran into a concentration of 1 mg/mL at room temperature under the dissolution condition using a ultrasonic disperser for 5 minutes. The thus obtained solution is filtered through a membrane filter having a pore size of 0.2 μm to obtain a sample solution. Besides, 10 μL of the sample solution is poured into the GPC apparatus together with the carrier solvent. Then, respective components of the resin are detected using a refractive index detector (RI detector), and a molecular weight distribution of the sample is calculated based on a calibration curve precedently measured using a monodisperse polystyrene standard particle.

The calibration curve is created, for example, by using standard polystyrene samples for calibration curve measurement, manufactured by Pressure Chemical Company, respectively having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, and measuring at least about 10 standard polystyrene samples. In this measurement, a refractive index detector is used for the detection.

<Production of Carrier>

A high-speed stirring mixer equipped with a horizontal stirring blade was charged with 100 parts by mass of the carrier core particle and 4.5 parts by mass of the core coating resin, and the resultant was mixed and stirred at 22° C. for 15 minutes under a condition of a peripheral speed of the horizontal blade of 8 m/sec, and further mixed at 120° C. for 50 minutes. Thus, the surface of the core particle was coated with the core coating resin by the function of mechanical impact (i.e., by a mechanochemical method) to produce a carrier.

Examples 1 to 24

Production of Developers 1 to 24

The carrier and each of respective toners 1 to 24 were mixed using a V-shaped mixer for 30 minutes to attain a toner concentration of 7 mass %, and thus, developers 1 to 24 were produced.

Comparative Examples 1 to 8

Production of Developers 25 to 32

The carrier and each of respective toners 25 to 32 were mixed using a V-shaped mixer for 30 minutes to attain a toner concentration of 7 mass %, and thus, developers 25 to 32 were produced.

<Evaluation>

Each of developers 1 to 32 was subjected, for evaluation, to an actual printing test by the following evaluation method using a digital printer "bizhub PRESS C1070" (manufactured by Konica Minolta, Inc., "bizhub" being their registered trademark). The digital printer has a structure schematically illustrated in FIG. 1, and additionally has the following configuration: The amount of a toner particle contained in the hopper of the developing device is detected, and if the amount of the toner particle in the hopper becomes insufficient, an empty indicator is lighted and the toner particle starts to be replenished from the toner bottle, and when a sufficient amount of the toner particle has been replenished, the empty indicator is extinguished. If the flow ability of the toner particle in the toner bottle is sufficiently high, the replenishment of the toner particle owing to the toner density sensor can be sufficiently rapidly performed, and hence, the hopper can always hold a sufficient amount of the toner particle.

(Evaluation of Bottle Dischargeability 1)

The toner bottle was filled with 1,100 g of each of developers 1 to 32, and 1,000 sheets were printed at each of the following coverage rates under normal temperature and normal humidity environment (temperature of 20° C. and humidity of 55% RH) with A4-size normal paper used as an image support. The developers were evaluated based on the following criteria depending on whether or not the toner empty indicator lamp was lighted. A toner evaluated as A to D can be used without any practical problem.

A: The empty indicator is not lighted even when 1,000 sheets are printed at a coverage rate of 100%.

B: Although the empty indicator is lighted when 1,000 sheets are printed at a coverage rate of 100%, the indicator is not lighted if the coverage rate is 90%.

C: Although the empty indicator is lighted when 1,000 sheets are printed at a coverage rate of 90%, the indicator is not lighted if the coverage rate is 80%.

D: Although the empty indicator is lighted when 1,000 sheets are printed at a coverage rate of 80%, the indicator is not lighted if the coverage rate is 70%.

E: The empty indicator is lighted when 1,000 sheets are printed even at a coverage rate of 70%.

(Evaluation of Bottle Dischargeability 2 (Evaluation of Flow Ability in Long-term Use)

The toner bottle was filled with 1,100 g of each of developers 1 to 32, and 10,000 sheets were printed at a coverage rate of 0% under normal temperature and normal humidity environment (temperature of 20° C. and humidity of 55% RH) with A4-size normal paper used as an image support. Thereafter, 1,000 sheets were printed at each of the following coverage rates, and evaluation was made based on the following criteria depending on whether or not the toner empty indicator was lighted. A toner evaluated as A to D can be used without any practical problem.

A: The empty indicator is not lighted even when 1,000 sheets are printed at a coverage rate of 100%.

B: Although the empty indicator is lighted when 1,000 sheets are printed at a coverage rate of 100%, the indicator is not lighted if the coverage rate is 90%.

C: Although the empty indicator is lighted when 1,000 sheets are printed at a coverage rate of 90%, the indicator is not lighted if the coverage rate is 80%.

D: Although the empty indicator is lighted when 1,000 sheets are printed at a coverage rate of 80%, the indicator is not lighted if the coverage rate is 70%.

E: The empty indicator is lighted when 1,000 sheets are printed even at a coverage rate of 70%.

(Evaluation of Lubricant (Fatty Acid Metal Salt) Filming)

Under normal temperature and normal humidity environment (temperature of 20° C. and humidity of 55% RH) with A4-size normal paper used as an image support, each of developers 1 to 32 was used for printing a half-tone image (test image) having an absolute reflection density of 0.50 as an initial print, then an image with a pixel ratio of 3% was printed continuously on 10,000 A4-size sheets, and subsequently, the test image was printed on an A4-size sheet. In each of the test images respectively output initially and after printing the 10,000 sheets, a reflection density in each of arbitrary 20 positions was measured with an image densitometer (Macbeth RD914), and a difference between the maximum value and the minimum value of the reflection density was obtained. If the difference between the maximum value and the minimum value exceeds 0.5, a practical problem occurs, and hence the developer is determined as defective.

(Evaluation of Silica Filming)

Under normal temperature and normal humidity environment (temperature of 20° C. and humidity of 55% RH) with A4-size normal paper used as an image support, each of developers 1 to 32 was used for printing a half-tone image (test image) having an absolute reflection density of 0.50 as an initial print, then an image with a pixel ratio of 30% was printed continuously on 10,000 A4-size sheets, and subsequently, the test image was printed on an A4-size sheet. In each of the test images respectively output initially and after printing the 10,000 sheets, a reflection density in each of arbitrary 20 positions was measured, and a difference between the maximum value and the minimum value of the reflection density was obtained. If the difference between the maximum value and the minimum value exceeds 0.5, a practical problem occurs, and hence the developer is determined as defective.

(Evaluation of Transferability Retention)

Under normal temperature and normal humidity environment (temperature of 20° C. and humidity of 55% RH) with A4-size normal paper used as an image support, each of developers 1 to 32 was used for printing a half-tone image (test image) having an absolute reflection density of 0.70 as an initial print, then an image with a pixel ratio of 1% was printed continuously on 10,000 A4-size sheets, and subsequently, the test image was printed. In each of the test images respectively output initially and after printing the 10,000 sheets, a reflection density in each of arbitrary 20 positions was measured with an image densitometer (Macbeth RD914), and an average of the reflection densities of each test image was obtained. Then, a ratio (%) of the reflection density average of the test image output after printing the 10,000 sheets to the reflection density average of the initial test image was calculated, and the retention of the transferability was determined based on the following criteria:

Ratio being 95% or higher: A difference cannot be visually found, and there arises no problem.

Ratio being 90% or higher and lower than 95%: Although a difference can be visually found, there arises no practical problem.

Ratio being lower than 90%: There arises a practical problem.

The toners used in developers 1 to 24 and their evaluation results are shown in Table 5, and the toners used in developers 25 to 32 and their evaluation results are shown in Table 6.

TABLE 5

| Example No. | Developer No. | Toner No. | Bottle Discharge-ability 1 | Bottle Discharge-ability 2 | Silica Filming | Lubricant Filming | Transferability |
|---|---|---|---|---|---|---|---|
| 1 | 1 | 1 | A | A | 0.1 | 0.1 | 96 |
| 2 | 2 | 2 | A | A | 0.1 | 0.1 | 97 |
| 3 | 3 | 3 | A | A | 0.1 | 0.1 | 95 |
| 4 | 4 | 4 | B | B | 0.1 | 0.1 | 95 |
| 5 | 5 | 5 | A | A | 0.1 | 0.1 | 99 |
| 6 | 6 | 6 | A | A | 0.3 | 0.1 | 98 |
| 7 | 7 | 7 | A | A | 0.1 | 0.1 | 99 |
| 8 | 8 | 8 | A | A | 0.1 | 0.1 | 99 |
| 9 | 9 | 9 | A | A | 0.1 | 0.3 | 98 |
| 10 | 10 | 10 | A | A | 0.1 | 0.5 | 98 |
| 11 | 11 | 11 | A | A | 0.5 | 0.1 | 98 |
| 12 | 12 | 12 | A | A | 0.5 | 0.1 | 98 |
| 13 | 13 | 13 | A | A | 0.5 | 0.1 | 98 |
| 14 | 14 | 14 | A | A | 0.5 | 0.1 | 93 |
| 15 | 15 | 15 | D | D | 0.1 | 0.1 | 94 |
| 16 | 16 | 16 | D | D | 0 | 0.1 | 98 |
| 17 | 17 | 17 | B | D | 0 | 0.1 | 98 |
| 18 | 18 | 18 | D | D | 0 | 0.1 | 93 |
| 19 | 19 | 19 | B | D | 0 | 0.1 | 94 |
| 20 | 20 | 20 | C | C | 0 | 0.1 | 98 |
| 21 | 21 | 21 | B | B | 0 | 0.1 | 98 |
| 22 | 22 | 22 | B | B | 0 | 0.1 | 98 |
| 23 | 23 | 23 | A | A | 0 | 0.1 | 93 |
| 24 | 24 | 24 | D | D | 0 | 0.1 | 98 |

TABLE 6

| Comparative Example No. | Developer No. | Toner No. | Bottle Discharge-ability 1 | Bottle Discharge-ability 2 | Silica Filming | Lubricant Filming | Transferability |
|---|---|---|---|---|---|---|---|
| 1 | 25 | 25 | A | A | 0 | 0.1 | 88 |
| 2 | 26 | 26 | E | E | 0 | 0.1 | 98 |
| 3 | 27 | 27 | E | E | 0 | 0.1 | 98 |
| 4 | 28 | 28 | B | E | 0 | 0.1 | 98 |
| 5 | 29 | 29 | E | E | 0 | 0.1 | 88 |
| 6 | 30 | 30 | B | E | 0 | 0.1 | 89 |
| 7 | 31 | 31 | A | A | 0.7 | 0.1 | 88 |
| 8 | 32 | 32 | E | E | 0.1 | 0.1 | 89 |

Developers 1 to 24 were found to be sufficiently good in all the evaluations of the bottle dischargeability 1, the bottle dischargeability 2, the silica filming, the lubricant filming and the transferability.

Besides, as is obvious from the evaluation results of developers 5, 12 and 13, the fatty acid metal salt of the fatty acid metal salt particle is preferably zinc stearate from the viewpoint of inhibiting the silica filming.

As is obvious from the evaluation results of developers 1 to 5 and 16 to 19, the silica particle is preferably a particle produced by the sol-gel method, namely, a particle having a porous structure, from the viewpoint of appropriately controlling the size and the shape of the particle.

Furthermore, as is obvious from comparison in the evaluation results between developers 1 to 3 and 5 and 16 to 19 and developer 4, the silica particle is preferably hydrophobized with the alkylalkoxysilane compound represented by the following formula from the viewpoint of improving the bottle dischargeability. In the following formula, $R_1$ represents an optionally substituted straight chain $C_{4-16}$ alkyl group, and $R_2$ independently represents a methyl group or an ethyl group.

$$R_1—Si(OR_2)_3$$

As is obvious from comparison in the evaluation results between, for example, developers 1 to 3 and developer 5, the silica particle is particularly preferably hydrophobized with hexamethyldisilazane from the viewpoint of improving the transferability.

Besides, as is obvious from comparison in the evaluation results between developers 5 and 6 and developers 9 to 11, the contents of the silica particle and the fatty acid metal salt particle preferably satisfy the following formula from the viewpoint of sufficiently inhibiting both the silica filming and the lubricant filming. In the following formula, X represents the content (in parts by mass) of the fatty acid metal salt particle relative to 100 parts by mass of the toner base particle, and Y represents the content (in parts by mass) of the silica particle relative to 100 parts by mass of the toner base particle.

$$0.025 \leq X/Y \leq 0.075$$

Furthermore, as is obvious from comparison in the evaluation results between developer 20 and developer 21, the amorphous polyester resin is preferably a hybrid amorphous polyester resin formed by the chemical bonding of a polyester polymerized segment and another polymerized segment from the viewpoint of improving the bottle dischargeability. As is obvious from comparison in the evaluation results between developer 20 and developer 22, the crystalline polyester resin is also preferably a hybrid crystalline polyester resin formed by the chemical bonding of a polyester polymerized segment and another polymerized segment from the viewpoint of improving the bottle dischargeability. As is obvious from comparison in the evaluation results between developers 21 and 22 and developer 5, the amorphous polyester resin and the crystalline polyester resin are both more preferably hybrid polyester resins from the viewpoint of improving the bottle dischargeability.

Besides, as is obvious from comparison in the evaluation results between developer 20 and developers 21, 22 and 5, the another polymerized segment is preferably a vinyl-based polymerized segment from the viewpoint of improving the bottle dischargeability.

On the contrary, developer 25 is insufficient in the transferability. This is probably because the average circularity of the toner base particle is low. Developer 26 is insufficient in the bottle dischargeability. This is probably because the average circularity of the toner base particle is too high and hence the toner base particle is packed most closely in the toner bottle, and as a result, the adhesion to the toner bottle is increased to make the flow ability insufficient.

Besides, developer 27 is insufficient in both the bottle dischargeabilities. This is probably because the particle size of the silica particle is so small that a distance between the toner base particles in the toner is insufficiently controlled, and the flow ability of the toner is lowered and hence the bottle dischargeability is lowered. Developer 28 is insufficient in the bottle chargeability after long-term use (i.e., the bottle dischargeability 2). This is probably because the particle size of the silica particle is too large to hold the fatty acid metal salt particle on the surface of the toner base particle, and hence a distance between the toner base particles in the toner is insufficiently controlled to lower the bottle dischargeability.

Developer 29 is insufficient in the bottle dischargeability and the transferability. This is probably because the average circularity of the silica particle is too low to sufficiently control a distance between the toner base particles in the toner, and hence the flow ability of the toner is lowered. As a result, the bottle dischargeability is lowered and transferability becomes insufficient. Developer 30 is insufficient in the bottle dischargeability after long-term use (i.e., the bottle dischargeability 2) and the transferability. This is probably because the average circularity of the silica particle is so high that the silica particle is liable to be detached from the surface of the toner base particle, and hence, if the toner bottle is stored or used for a long period of time, the bottle dischargeability becomes insufficient, and the transferability becomes insufficient.

Besides, developer 31 is insufficient in the inhibition of the silica filming and the transferability. This is probably because the particle size of the fatty acid metal salt particle is so small that the lubricity of the toner becomes insufficient, and hence, the silica filming occurs and the transferability becomes insufficient. Developer 32 is insufficient in the bottle dischargeability and the transferability. This is probably because the particle size of the fatty acid metal salt particle is so large that the fatty acid metal salt particle is not held on the surface of the toner base particle, and hence a distance between the toner base particles is insufficiently controlled. As a result, the bottle dischargeability becomes insufficient, and the transferability becomes insufficient.

According to the present invention, good flow ability of a toner capable of forming high quality images can be retained for a long period of time. Therefore, the electrophotographic image forming technique is expected to be further developed by the present invention.

What is claimed is:

1. A toner comprising: a toner particle containing a toner base particle and an external additive adhering to a surface of the toner base particle, the toner base particle containing a crystalline polyester resin and an amorphous polyester resin, the toner particle having an average circularity of 0.945 or higher and lower than 0.965, the external additive containing a silica particle and a fatty acid metal salt particle, wherein the silica particle has a volume average particle size of 70 nm or more and 300 nm or less, the silica particle has an average circularity of 0.5 or higher and 0.9 or lower, and the fatty acid metal salt particle has a median diameter based on a volume of 0.50 μm or more and less than 2.00 μm.

2. The toner according to claim 1, wherein a fatty acid metal salt contained in the fatty acid metal salt particle is zinc stearate.

3. The toner according to claim 1, wherein the silica particle has a porous structure.

4. The toner according to claim 1, wherein the silica particle has been hydrophobized with an alkylalkoxysilane compound represented by the following formula:

$$R_1—Si(OR_2)_3$$

wherein $R_1$ represents an optionally substituted straight chain $C_{4-16}$ alkyl group, and $R_2$ independently represents a methyl group or an ethyl group.

5. The toner according to claim 1, wherein the silica particle has been hydrophobized with hexamethyldisilazane.

6. The toner according to claim 1, wherein. contents of the silica particle and the fatty acid metal salt particle satisfy the following formula:

$$0.025 \leq X/Y \leq 0.075$$

wherein X represents the content (in parts by mass) of the fatty acid metal salt particle relative to 100 parts by mass of the toner base particle, and Y represents the content (in parts by mass) of the silica particle relative to 100 parts by mass of the toner base particle.

7. The toner according to claim 1, wherein the amorphous polyester resin is a hybrid amorphous polyester resin formed by chemical bonding of a polyester polymerized segment and another polymerized segment.

8. The toner according to claim 1, wherein the crystalline polyester resin. is a hybrid crystalline polyester resin formed by chemical bonding of a polyester polymerized segment and another polymerized segment.

9. The toner according to claim 7, wherein the another polymerized segment is a vinyl-based polymerized segment.

* * * * *